US007290764B2

(12) United States Patent
Marasco

(10) Patent No.: US 7,290,764 B2
(45) Date of Patent: Nov. 6, 2007

(54) MODULAR GUIDE APPARATUS FOR TAB STOCK RECEIVED IN A FEEDER TRAY

(75) Inventor: Joseph Marasco, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 285 days.

(21) Appl. No.: 11/118,534

(22) Filed: Apr. 29, 2005

(65) Prior Publication Data

US 2006/0244199 A1 Nov. 2, 2006

(51) Int. Cl.
*B65H 1/00* (2006.01)

(52) U.S. Cl. ..... 271/145; 271/1; 271/171

(58) Field of Classification Search ..... 271/145, 271/1, 241, 171, 170
See application file for complete search history.

(56) References Cited

U.S. PATENT DOCUMENTS 4,501,417 A * 2/1985 Foster et al. ..... 271/124
4,589,645 A * 5/1986 Tracy ..... 271/3.03
5,135,213 A * 8/1992 Malachowski et al. ..... 271/104
5,245,397 A * 9/1993 Mahoney ..... 399/402
5,391,009 A * 2/1995 Stodder ..... 400/605
5,480,131 A * 1/1996 Furukawa et al. ..... 271/9.06
5,511,771 A 4/1996 Rubscha
5,700,003 A * 12/1997 Sung ..... 271/110
5,876,030 A * 3/1999 Dobbertin et al. ..... 271/13
5,946,527 A 8/1999 Salgado et al.
6,186,492 B1 2/2001 Dechau et al.
6,206,362 B1 * 3/2001 Tan et al. ..... 271/145
6,264,188 B1 7/2001 Taylor et al.
6,302,390 B1 10/2001 Clark et al.
6,352,255 B1 3/2002 Taylor
6,523,822 B1 * 2/2003 Galtier et al. ..... 271/171
6,746,011 B2 6/2004 Miller et al.

(Continued)

FOREIGN PATENT DOCUMENTS

JP 08217324 A * 8/1996

(Continued)

*Primary Examiner*—Patrick Mackey
*Assistant Examiner*—Gerald W McClain
(74) *Attorney, Agent, or Firm*—Maginot, Moore & Beck

(57) ABSTRACT

A tab guide is provided for aligning tab stock in a paper tray of a printer having a trail edge guide including a substantially planar sheet-engaging face and a stack height finger extending from the sheet engaging face in a process direction for engaging a top surface of a top sheet on a stack adjacent the trailing edge of the sheet. The tab guide comprises a top flange, a trailing edge flange and a mount. The top flange has a top surface and a sheet-engaging surface. The trailing edge flange has a substantially planar trailing edge-engaging surface. The mount couples the top flange and the trailing edge flange. The mount is configured to removably mount the top flange and trailing edge flange to the trail edge guide and when so mounted to position the top surface of the top flange in engagement with a bottom of the stack height finger, to position the sheet-engaging surface of the top flange in engagement with a top surface located adjacent a trailing edge of a top sheet in a stack of tab stock received in the paper tray and to position the trailing edge-engaging surface of the trailing edge flange in engagement with tabs located on the trailing edge of a plurality of the uppermost sheets in the stack of tab stock received in the paper tray.

16 Claims, 18 Drawing Sheets

U.S. PATENT DOCUMENTS

| | | | | |
|---|---|---|---|---|
| 6,863,272 | B2 | 3/2005 | DiNatale et al. | |
| 7,063,315 | B2 * | 6/2006 | Lyu et al. | 271/38 |
| 7,159,863 | B2 * | 1/2007 | Murrell et al. | 271/157 |
| 2004/0207144 | A1 * | 10/2004 | Kanome et al. | 271/9.01 |

FOREIGN PATENT DOCUMENTS

| | | | | |
|---|---|---|---|---|
| JP | 09127800 | A | * | 5/1997 |
| JP | 2000229732 | A | * | 8/2000 |

* cited by examiner

MODULAR GUIDE APPARATUS FOR TAB STOCK RECEIVED IN A FEEDER TRAY

BACKGROUND AND SUMMARY

This disclosure relates generally to a feeder apparatus utilized in electronic reprographic printing system, and more particularly concerns a feeder apparatus for feeding of tab stock.

In the process of electrostatographic reproduction, a light image of an original to be copied or printed is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure.

Sheet handling systems feed paper or other media through each process station in a rapid succession in a reliable and dependable manner in order to utilize the full capabilities of the reproduction machine. These sheet handling systems must operate flawlessly to virtually eliminate risk of damaging the recording sheets and generate minimum machine shutdowns due to mis-feeds or multi-feeds. It is in the initial separation of the individual sheets from the media stack where the greatest number of problems occurs.

Some sheet feeding apparatus (commonly referred to as "fluffers" or "air knives") utilize positive air flow over the top sheet in a stack of sheets and air flow between sheets at the leading edge to separate the top sheet from underlying sheets so that only the top sheet is captured for feeding. The use of fluffers or air knives to help separate and/or levitate sheets for improved sheet separation and feeding is an extensively developed art, with numerous patents. The following are noted by way of some recent examples of U.S. patents with disclosures of such systems, and for other such art cited therein: U.S. Pat. No. 6,186,492 issued Feb. 13, 2001 to Dechau, et al; U.S. Pat. No. 6,264,188 issued Jul. 24, 2001 to Taylor, et al; and U.S. Pat. No. 6,352,255 issued Mar. 5, 2002 to Taylor and U.S. Pat. No. 6,746,011 issued Jun. 8, 2004 to Miller et al. U.S. Pat. No. 6,186,492 also discloses an example of a reciprocating vacuum feed head or "shuttle feeder," with which the disclosed tab guide may be desirably combined, but is not limited thereto.

Sheet fluffers may also be combined in the same sheet separator/feeder system with what may be alternatively called "air knives" blowing against at least the upper portion of the front, feeding out, or downstream edge or a side edge of the stack in coordination with the individual sheet acquisition and feeding. Stack fluffing and/or vacuum sheet feeding is particularly desirable for higher speed printing systems, for providing more reliable high speed sheet separation and feeding and also for reduced marking or scuffing of sheet surfaces as compared to "friction retard" or other such sheet separator/feeders which are more commonly used on slower, lower cost, printers.

As used herein, the term "printers" will be understood to broadly include copiers, printers, multifunction devices, etc., with xerographic, ink jet, or other print media printing systems. The term "sheet" as used herein refers to various print media sheets, of various sizes and weights, typically relatively thin, flexible or even flimsy paper, and sometimes even plastic (such as for overhead transparencies). As used herein, the term "tab stock" will refer to sheets having an even edge and an opposed uneven edge with a projection spaced along such uneven edge. The projection (tab), which for example can serve as a location for a label (pre-printed or printed by the reproduction apparatus), enables the sheet to separate or provide divisions in a copy set.

Fluffer feeders typically utilize paper trays for supporting the stacks of sheets that include side guides and edge guides for maintaining the sheets in proper orientation and position for feeding. Trail edge guides often include actuator arms or stack height fingers for engaging the top surface of the top sheet in the stack adjacent the "trailing edge" (i.e. the edge opposite the "leading edge" which is the first edge of the sheet to entire the transfer device). It will also be appreciated that various types of variously slide-mounted or otherwise movable stack side and edge guides are well known in the art, for various sheet stacking trays, and thus all such side and edge guides need not be described in any detail herein. Such side and edge guides can be reset to the size of the stack of sheets currently being loaded into the tray to generally confine the sheets between such guides.

The stack side guides can also assist in linear sheet feeding of the sheets in the orthogonal feeding direction. One, or both, opposing side guides (herein referred to as front and rear side guides because of the feed direction of the sheets) may be movable. If both side guides are moveable they may optionally be ganged for coordinated movement towards or away from one another by a rack and pinion connection, as is also well known, e.g. U.S. Pat. Nos. 5,511,771 and 5,946,527. This allows for a "center registered" sheet feeding system instead of an "edge registered" system. An "edge registered" system is shown in U.S. Pat. No. 6,302,390. In a "center registered" sheet feeding system, such as that illustrated herein, in which the side guides are ganged the operator resetting movement of one side guide automatically moves the opposing side guide.

A movable stack trail edge guide is also provided in sheet feeding trays, opposite from the feed-out end of the stack, movable in the process direction. The trail edge guide may also be movable at an angle to the stack for substantially centering on the trailing edge of different widths of sheet stacks, as in Xerox Corp. U.S. Pat. No. 6,302,390.

In many paper trays, the trail edge guides are configured to engage only a central portion of the edges of the stacks of sheets that they position and orient. Thus, substantial portions of the trailing edges of the sheets in the stack are not in engagement with the trail edge guide. Also, the actuator arm or stack height finger is typically disposed within the trail edge guide. The actuator arm or stack height finger engages a portion of the center of the top surface of the top sheet in the stack adjacent the trailing edge. The actuator arm or stack height finger acts as a sensor to control the sheet elevator in the paper tray to properly position the top sheet of the stack for acquisition by the feeder head. The actuator arm or stack height finger also applies a very light (to avoid marking the sheet) downward force on the top sheet of the stack which facilitates the use of a fluffer.

Such trail edge guides and actuator arms operate very well with sheets having even trailing edges. However, such guides and actuator arms may not operate well when tab stock is loaded in the tray with the uneven edge (the edge including the tabs) being positioned as the trailing edge.

Due at least in part to the projections, typical reproduction apparatus sheet feeders have some difficulty in reliably feeding tab stock. Tab stock is typically oriented in printers so that the uneven edge is the trailing edge to avoid feeding, transfer and registration problems that may arise when transferring tab stock with the uneven edge being the leading edge. Such problems are well documented and need not be explained in any detail.

The individual tabbed sheets of the tab stock sheet stack, as best seen in FIG. 4, respectively have tabs (in the illustrated embodiment including five tab stock referred to as $T_1$-$T_5$) spaced along an uneven marginal edge of the stack. The uneven marginal edge can be envisioned as having an even marginal edge portion or portions in the areas where the tab is not located and a tabbed marginal edge projecting beyond the even marginal edge portion. As such, although the even marginal edge portion of the stack itself is even, the tabbed marginal edge of each sheet is not even. It is common for the tabbed marginal edge to project between nine to thirteen millimeters beyond the even marginal edge portion of the uneven edge of tab stock.

The tabs are located longitudinally in different locations along the uneven edge of the tab stock. Alphabetical tab stock in English speaking countries often comes in sets that include twenty-six differently lettered tabs. Each differently lettered tab is in a different position along the uneven edge of the tab stock. The width of the each tab in a tab stock set is often approximately equal to the length of the uneven edge divided by the number of differently positioned tabs in the set. Numbered and blank tab stock sets may include more or fewer differently positioned tabs along the uneven edge. It is common for tab stock sets to include as many as thirty-one differently positioned tabs. Thus, only the tabs on tab stock having the tab positioned in the center region of the uneven edge of a tab stock set would engage a trail edge guide that is designed to engage the center of the sheets in the paper tray. Other tab stock in the tab stock set would not be restrained in the proper orientation by such a trail edge guide. As an example, portions or all of tabs T2, T3, and T4 would be in engagement with the illustrated trail edge guide while tabs T1 and T5 would not engage the illustrated trail edge guide.

Actuator arms or stack height fingers that are disposed in trail edge guides are typically relatively thin so that they engage only a small portion of the top surface of the top sheet in the stack. The actuator arms or stack height fingers typically do not extend too far (around six to fifteen millimeters) in the process direction away from the trail edge guide. Thus, when a tab stock set is loaded in a paper tray with the uneven edge oriented as the trailing edge, some shorter stack height fingers would engage only the tabs on the tab stock in the tab stock set that have the tabs positioned in the center of the uneven edge while longer stack height fingers would engage the top surface of all of the tab stock very close to the trailing edge. When tab stock in the tab stock set that does not have its tab positioned in the center of the uneven edge becomes the top sheet in the stack, the stack height finger either does not engage the tab stock or engages only a very small portion of the top sheet in the stack adjacent the even marginal edge portion of uneven trailing edge.

The stack height finger disclosed herein extends approximately fourteen millimeters in the process direction away from the trail edge guide. Thus, when used with typical tab stock, the disclosed stack height finger would only extend between one to five millimeters beyond the even portion of the uneven marginal edge to engage the top surface of tab stock having non-centered tabs. This can adversely affect the operation of the fluffer which when blowing may cause the stack height finger to become disengaged from the top sheet of the stack and result in inaccurate positioning of the top sheet relative to the feeder head.

Owners and operators of printers would appreciate a device that properly positions and orients tab stock for feeding. A device that properly engages the top surface of the top sheet in a stack adjacent the trailing edge of tab stock to facilitate fluffer feeding of the tab stock would also be appreciated. A device that could be added to a current paper tray to facilitate handling of tab stock without modification or replacement of the tray would also be appreciated.

According to one aspect of the disclosure, a tab guide is provided for aligning tab stock in a paper tray of a printer having a trail edge guide including a substantially planar sheet-engaging face and a stack height finger extending from the sheet-engaging face in a process direction for engaging a top surface of a top sheet on a stack adjacent the trailing edge of the sheet. The tab guide comprises a top flange, a trailing edge flange and a mount. The top flange has a top surface and a sheet-engaging surface. The trailing edge flange has a substantially planar trailing edge-engaging surface. The mount couples the top flange and the trailing edge flange. The mount is configured to removably mount the top flange and trailing edge flange to the trail edge guide and when so mounted to position the top surface of the top flange in engagement with a bottom of the stack height finger, to position the sheet-engaging surface of the top flange in engagement with the top surface of the top sheet in a stack of tab stock received in the paper tray and to position the trailing edge-engaging surface of the trailing edge flange in engagement with tabs located on the trailing edge of a plurality of the uppermost sheets in the stack of tab stock received in the paper tray.

According to another aspect of the disclosure, a method of configuring a paper tray having a trail edge guide with a substantially planar sheet-engaging face having a width and a stack height finger to properly align tab stock is provided. The stack height finger has a width and extends a length in a process direction from the sheet-engaging surface. The tab stock has a length along an uneven edge and includes tabs extending a width from an even marginal edge thereof. The tab stock is positioned adjacent the trail edge guide. The method comprises temporarily effectively extending the width of the sheet-engaging face to approximately equal to or less than the length of the uneven edge and temporarily effectively extending the length of the actuator arm to significantly greater than the width of the tab.

According to yet another aspect of the disclosure, a paper tray for an electrostatographic printer for properly aligning tab stock having an uneven edge including tabs to be processed with the uneven edge being the trailing edge of the tab stock is disclosed. The paper tray comprises a sheet-receiving region, a trail edge guide and a tab guide. The sheet-receiving region receives a stack of sheets to be fed to the electrostatographic printer in a feed direction and has a lead edge side and a trailing edge side having a length. The trail edge guide is adjacent the trailing edge side of the sheet-receiving region and movable into engagement with a trailing edge of a stack of sheets received in the sheet-receiving region. The trail edge guide includes a sheet-engaging face having a width less than the length of the trailing edge side of the sheet-receiving region. The tab guide includes a top flange, a trailing edge flange and a mount. The top flange has a top surface and a sheet-engaging surface. The trailing edge flange has a substantially planar trailing edge-engaging surface. The mount couples the top flange and the trailing edge flange. The mount is configured to removably mount the top flange and trailing edge flange to the trail edge guide and when so mounted to position the top surface of the top flange in engagement with a bottom of the stack height finger, to position the sheet-engaging surface of the top flange in engagement with a top surface adjacent a trailing edge of a top sheet in a stack of tab stock received in the sheet-receiving region and to position the trailing edge-engaging surface of the trailing edge flange in engagement with tabs located on a trailing edge of a plurality of the uppermost sheets in the stack of tab stock received in the sheet-receiving region.

Additional features and advantages of the presently disclosed tab guide will become apparent to those skilled in the art upon consideration of the following detailed description of embodiments exemplifying the best mode of carrying out the disclosure as presently perceived.

BRIEF DESCRIPTION OF THE DRAWINGS

A more complete understanding of the disclosed apparatus can be obtained by reference to the accompanying drawings wherein.

Corresponding reference characters indicate corresponding parts throughout the several views. Like reference characters tend to indicate like parts throughout the several views.

DETAILED DESCRIPTION

Figure 1:
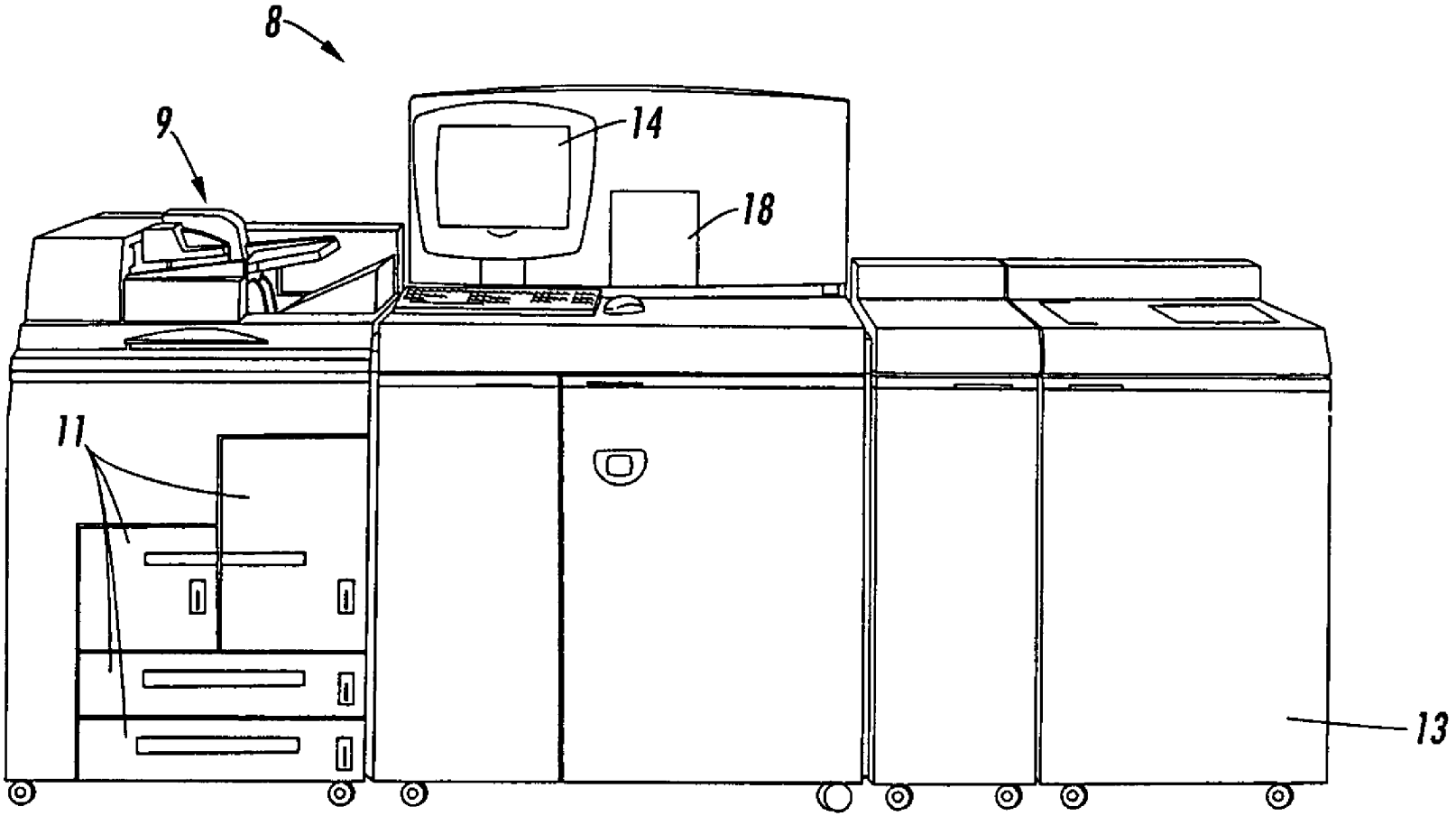
FIG. 1 is a view of a printer having feeding mechanism including four pull out drawers holding paper trays, a print engine and a finishing module in which the disclosed tab guides may be utilized.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art to which this disclosure pertains.

Referring to FIG. 1 there is shown a printer 8 having feeding mechanism 9 including four pull out drawers 11 holding paper trays 86, a print engine 18 and a finishing module 13 in which the disclosed tab guide 100, 200 may be utilized. For purposes of illustration, it is assumed that each drawer 11 contains a paper tray 86 having a trail edge guide 90 in which an actuator arm or stack height finger 92 is incorporated. Thus, the disclosed tab guides 100, 200 may be utilized with any paper tray 82 in the printer 8. As mentioned, the print engine 18 may be a copier, printer, multifunction device, etc., with xerographic, ink jet, or other print media printing systems. The finishing module 13 is not required for utilization of the disclosed tab guides 100, 200. However, certain finishing modules 13, in particular inserters, may utilize a feeding system for capturing sheets from a paper tray that would benefit from utilizing the disclosed tab guides 100, 200 when tab stock 101 is to be fed from the inserter, within the scope of the disclosure. The printer 8 in which the disclosed tab guides 100, 200 are utilized may include a finishing module 13 that includes any commonly available finishing device such as a stacker, stapler, binder, folder, inserter etc.

Inasmuch as the art of electrostatographic printing is well known, the various processing stations employed printer 8 will be shown hereinafter schematically and their operation described briefly with reference thereto with reference to FIG. 2.

Figure 2:
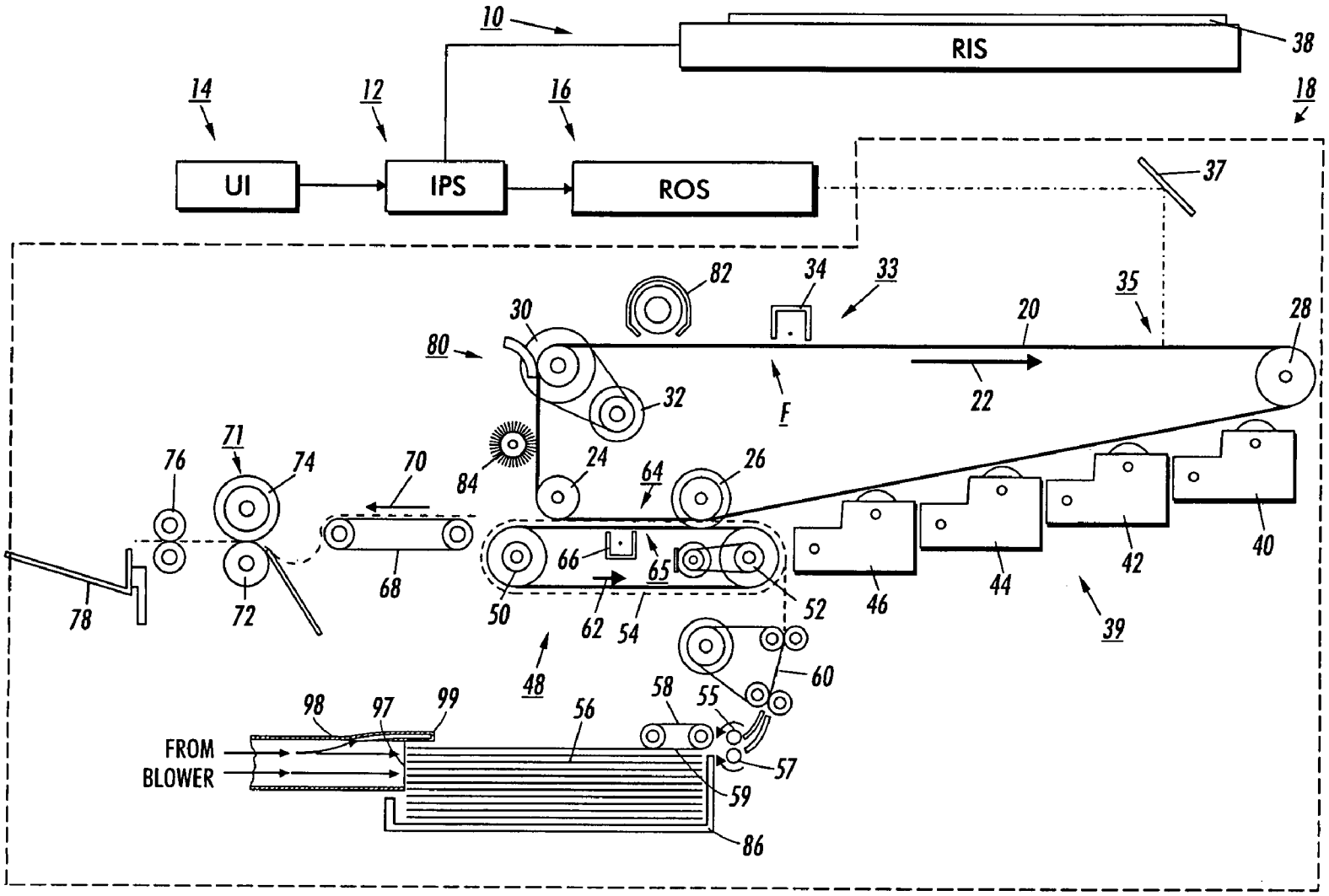
FIG. 2 is a schematic elevation view of an illustrative electrostatographic printer in which the disclosed tab guides may be utilized.

By way of a general explanation, FIG. 2 is a schematic elevation view showing an electrostatographic printer 8 with which the disclosed tab guides 100, 200 may be utilized. While FIG. 2 illustrates a color printer, it is within the scope of the disclosure for the disclosed tab guides 100, 200 to be utilized with a black and white printer. It will become evident from the following discussion that the disclosed tab guides 100, 200 may easily be modified to interact with other feeder paper trays and is equally well suited for use in a wide variety of copying and printing systems, and is not necessarily limited in its application to the particular system shown herein.

As shown in FIG. 2, during operation of the printing system 8, a color or black/white original document 38 is positioned on a raster input scanner (RIS) 10. The RIS 10 contains document illumination lamps, optics, a mechanical scanning drive, and a charge coupled device (CCD array). The RIS 10 captures the entire image from the original document 38 and converts it to a series of raster scan lines and moreover measures a set of primary color densities, i.e. red, green and blue densities, at each point of the original document. This information is transmitted as electrical signals to an image processing system (IPS) 12. The IPS 12 converts the set of red, green and blue density signals to a set of colorimetric coordinates.

The IPS 12 contains control electronics which prepare and manage the image data flow to a raster output scanner (ROS) 16. A user interface (UI) 14, is in communication with the IPS 12. The UI 14 enables an operator to control the various operator adjustable functions. The operator actuates the inputs of the UI 14 to adjust the parameters of the copy. The UI 14 may be a touch screen, or any other suitable control panel, providing an operator interface with the system. The output signal from the UI 14 is transmitted to the IPS 12. The IPS 12 then transmits signals corresponding to the desired image to the ROS 16, which creates the output copy image. The ROS 16 includes a laser with rotating polygon mirror blocks. The ROS 16 illuminates, via a mirror 37, the charged portion of a photoconductive belt 20 of a printer or print engine 18 to achieve a set of subtractive primary latent images. The ROS 16 will expose the photoconductive belt 20 to record three latent images which correspond to the signals transmitted from the IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 2, the print engine 18 is an electrostatographic printer including the photoconductive belt 20 that moves in the direction of arrow 22 to advance successive portions of the photoconductive surface sequentially through the various processing stations disposed about the path of movement thereof. The photoconductive belt 20 is entrained about transfer rollers 24 and 26, a tensioning roller 28, and a drive roller 30. The drive roller 30 is rotated by a motor 32 coupled thereto by suitable means such as a belt drive. As the roller 30 rotates, it advances the belt 20 in the direction of the arrow 22.

Initially, a portion of the photoconductive belt 20 passes through a charging station 33. At the charging station 33, a corona generating device 34 charges the photoconductive belt 20 to a relatively high, substantially uniform potential.

Next, the charged photoconductive surface is rotated to an exposure station 35. The exposure station 35 receives a modulated light beam corresponding to information derived by the RIS 10 having the multicolored original document 38 positioned thereat. The modulated light beam impinges on the surface of the photoconductive belt 20. The beam illuminates the charged portion of the photoconductive belt 20 to form an electrostatic latent image. In a color printer, the photoconductive belt 20 is exposed three times to record three latent images thereon.

After the electrostatic latent images have been recorded on the photoconductive belt 20, the belt 20 advances such latent images to a development station 39. The development station 39 includes four individual developer units 40, 42, 44, and 46. The developer units 40, 42, 44, and 46 are of a type generally referred to in the art as "magnetic brush development units." Typically, a magnetic brush development system employs a magnetizable developer material including magnetic carrier granules having toner particles adhering triboelectrically thereto. Development is achieved by bringing the brush of developer material into contact with the photoconductive surface. The developer units 40, 42, and 44, respectively, apply toner particles of a specific color which corresponds to the compliment of the specific color separated electrostatic latent image recorded on the photoconductive surface.

The charged areas are then made visible by having the developer unit 40 apply green absorbing (magenta) toner particles onto the electrostatic latent image recorded on the photoconductive belt 20. Similarly, a blue separation is developed by the developer unit 42 with blue absorbing (yellow) toner particles, while the red separation is developed by the developer unit 44 with red absorbing (cyan) toner particles. The developer unit 46 contains black toner particles and may be used to develop the electrostatic latent image formed from a black and white original document.

After development, the toner image is moved to a transfer station 65. The transfer station 65 includes a transfer zone 64. In the transfer zone 64, the toner image is transferred to a sheet of support material, such as plain paper or tab stock 101 amongst others. At the transfer station 65, a sheet transport apparatus 48, moves the sheet into contact with the photoconductive belt 20. The sheet transport apparatus 48 has a pair of spaced belts 54 entrained about a pair of substantially cylindrical rollers 50 and 52. A sheet gripper (not shown in FIG. 1) extends between the belts 54 and moves in unison therewith. A sheet is advanced from a stack of sheets 56 disposed on a paper tray 86. A feeder 58 advances the uppermost sheet from the stack 56 onto a pre-transfer transport 60. The transport 60 advances a sheet to the sheet transport 48. The sheet is advanced by the transport 60 in synchronism with the movement of the sheet gripper. In this way, the leading edge of the sheet arrives at a preselected position, i.e. a loading zone, to be received by the open sheet gripper.

As the belts 54 move in the direction of the arrow 62, the sheet moves into contact with the photoconductive belt 20, in synchronism with the toner image developed thereon. In the transfer zone 64, a gas directing mechanism (not shown in FIG. 2) directs a flow of gas onto the sheet to urge the sheet toward the developed toner image on the photoconductive belt 20 so as to enhance contact between the sheet and the developed toner image in the transfer zone. Further, in the transfer zone 64, a corona generating device 66 charges the backside of the sheet to the proper magnitude and polarity for attracting the toner image from the photoconductive belt 20 thereto.

Each of the electrostatic latent images recorded on the photoconductive surface 25 is developed with the appropriately colored toner and transferred, in superimposed registration with one another, to the sheet to form the multicolor copy of the colored original document.

After the last transfer operation, the sheet transport system directs the sheet to a vacuum conveyor 68. The vacuum conveyor 68 transports the sheet, in the direction of the arrow 70, to a fusing station 71, where the transferred toner image is permanently fused to the sheet. The fusing station includes a heated fuser roll 74 and a pressure roll 72. The sheet passes through the nip defined by the fuser roll 74 and the pressure roll 72. The toner image contacts the fuser roll 74 so as to be affixed to the sheet. Thereafter, the sheet is advanced by a pair of rolls 76 to a catch tray 78 or other finishing module for subsequent removal therefrom by the machine operator.

The final processing station in the direction of movement of the photoconductive belt 20, as indicated by arrow 22, is a photoreceptor cleaning station 80. The photoreceptor cleaning station 80 includes a vacuum 82 for collecting toner removed from the photoconductive belt by a brush 84.

The sequence of operation of the sheet feeder 58 is as follows. A stack of sheets 56 is placed onto the elevator plate 83 in the sheet-receiving region of the paper tray 86. The paper tray 86 includes in the illustrated embodiment a rear side guide 81, a front side guide 88, a trail edge guide 90 and a registration wall (not numbered) on sides of the elevator plate 83 in the sheet-receiving region. The rear side guide 81, front side guide 88 and trail edge guide 90 are of the type well known in the art that permit the side and edge guides 81, 88, 90 to be moved reciprocally perpendicular to the edges of the sheets to be guided to accommodate different sizes of sheet material. As mentioned above, in the illustrated embodiment, rear side guide 81 and front side guide 88 are ganged for coordinated movement towards or away from one another by a rack and pinion connection to allow for a "center registered" sheet feeding system instead of an "edge registered" system. In a "center registered" sheet feeding system, such as that illustrated herein, the operator resetting movement of the front side guide 88 automatically moves the opposing rear side guide 81.

In the illustrated embodiment, the front side guide 88 and trail edge guide 90 include a handle assembly 89 and a registration wall or sheet-engaging face 91. The rear side guide 81 also includes a sheet-engaging face 91. The handle assembly 89 releases the side and edge guides 81, 88, 90 for movement perpendicular to the edge of the sheet to be guided. The sheet-engaging face 91 is configured and arranged to be substantially planar and to lie in a plane parallel to the plane formed by the even edges of properly aligned sheets in a stack of sheets 56. In the illustrated embodiment, the sheet-engaging face 91 can be assumed to lie in the vertical plane.

The illustrated trail edge guide 90 includes an upright post member 94 having a generally rectangular horizontal cross section. The upright post member 94 has a width 93 equal to the width of the sheet-engaging face 91 and a depth 95. In the illustrated embodiment, the width 93 of the trail edge guide 90 is smaller than the maximum length of the uneven edge of tab stock 101. Thus, when tab stock 101 is received in the paper tray 86, the sheet-engaging face 91 is not wide enough to engage all of the tabs of all of the tab stock 101 in some tab stock sets.

The trail edge guide 90 is formed to include an actuator arm or stack height finger 92 extending from the sheet-engaging face 91 in the process direction. Those skilled in the art will recognize that the term "process direction" is meant to mean the direction in which the sheet is fed from the tray 86 into the pre-transfer transport 60. The stack height finger 92 is configured to maintain the correct gap between the top sheet of the stack 56 and the feed head 58. The stack height finger 92 senses the height of the sheet stack 56 by engaging the top surface adjacent the trailing edge of the top sheet in a sheet stack 56. The stack height finger 92 actuates the elevator in the paper tray 86 to position the top sheet in the stack the correct distance from the feed head 58.

The stack height finger 92 extends a distance 85 (FIG. 14) in the process direction from the sheet-engaging face 91 of the trail edge guide 90. As mentioned above, in the illustrated embodiment, this distance 85 is approximately fourteen millimeters. Illustratively, the stack height finger 92 has a width 87 that is substantially smaller than the width 93 of the sheet-engaging face 91 of the trail edge guide 90.

To facilitate insertion of the stack 56 onto the elevator plate 83 of the sheet-receiving region of the paper tray 86, the paper side and edge guides 81, 88, 90 may be moved to the open position in order to accommodate the size of the sheets being inserted. Nevertheless operators often fail to open the side and edge guides 81, 88, 90 when inserting sheets into the paper tray 86. After a stack of sheets 56 is inserted in the paper tray 86, the paper side and edge guides 81, 88, 90 (if they were previously opened) are moved to engage their associated edges of the sheets. The stack height finger 92 on the trail edge guide 90 is positioned on the top surface of the top sheet in the stack 56. The drawer 11 containing the paper tray 86 is then closed and the printer 8 is then ready to process a print job utilizing the sheets in the stack 56.

When needed, the feeder head 58 pulls the top sheet from the stack of sheets 56 held in the tray. The fluffer 98 has air openings 97, 99 to facilitate acquisition of the top sheet by the feeder head 58. The fluffer 98 is arranged such that it may inject air between sheets in the stack 56 by a first air opening 97 and on the top surface of the top sheet in the stack 56 by a second air opening 99. An air knife or translating fluffer assembly 96 (FIG. 4) also injects air between the sheets through an opening in the rear side guide 81. The air pressure between sheets helps separate sheets, i.e. puffs the sheets up. The air on top of the surface of the sheet to be fed creates a Venturi effect to help lift the top sheet in the sheet stack 56 for acquisition by the vacuum shuttle feeder. The combined effects improve the speed of the sheet acquisition speed and ensure a single sheet feed.

In the vacuum shuttle feeder, before the sheet is acquired to the vacuum feed head 58 a high pressure side port from the translating fluffer assembly 96 fluffs the stack 56 to prevent multi-feeds. During fluffing, the stack height finger 92 is intended to control the height of the trailing edge of the top sheet in the stack 56 as the sheet is being acquired by the vacuum feed head 58. The stack height finger 92 also provides a slight downward force to the trailing edge of the sheet to permit the air injected between the sheets from the translating fluffer assembly 96 and fluffer 98 to pass farther between the sheets. The pressure applied is slight to minimize marking of the top sheet.

The feeder head or plenum 58 is located above the stack 56. The feeder plenum 58 includes a cavity which may be evacuated thereby forming a pressure differential. The difference in pressure between the inside of the feeder plenum 58 and the outside of the feeder plenum 58 forces the top sheet of the sheet stack 56 towards the vacuum paper contact surface 59 of the feeder plenum 58. The vacuum paper contact surface 59 employs a corrugated surface composed of a combination of ribs to reduce the bonding forces between paper surfaces thereby separating underlying sheets in the stack 56 from the top sheet in the stack 56. A drive assembly, attached to air plenum 58 translates the acquired sheet's leading edge into counter-rotating feed rollers 55 and 57.

Figure 5:
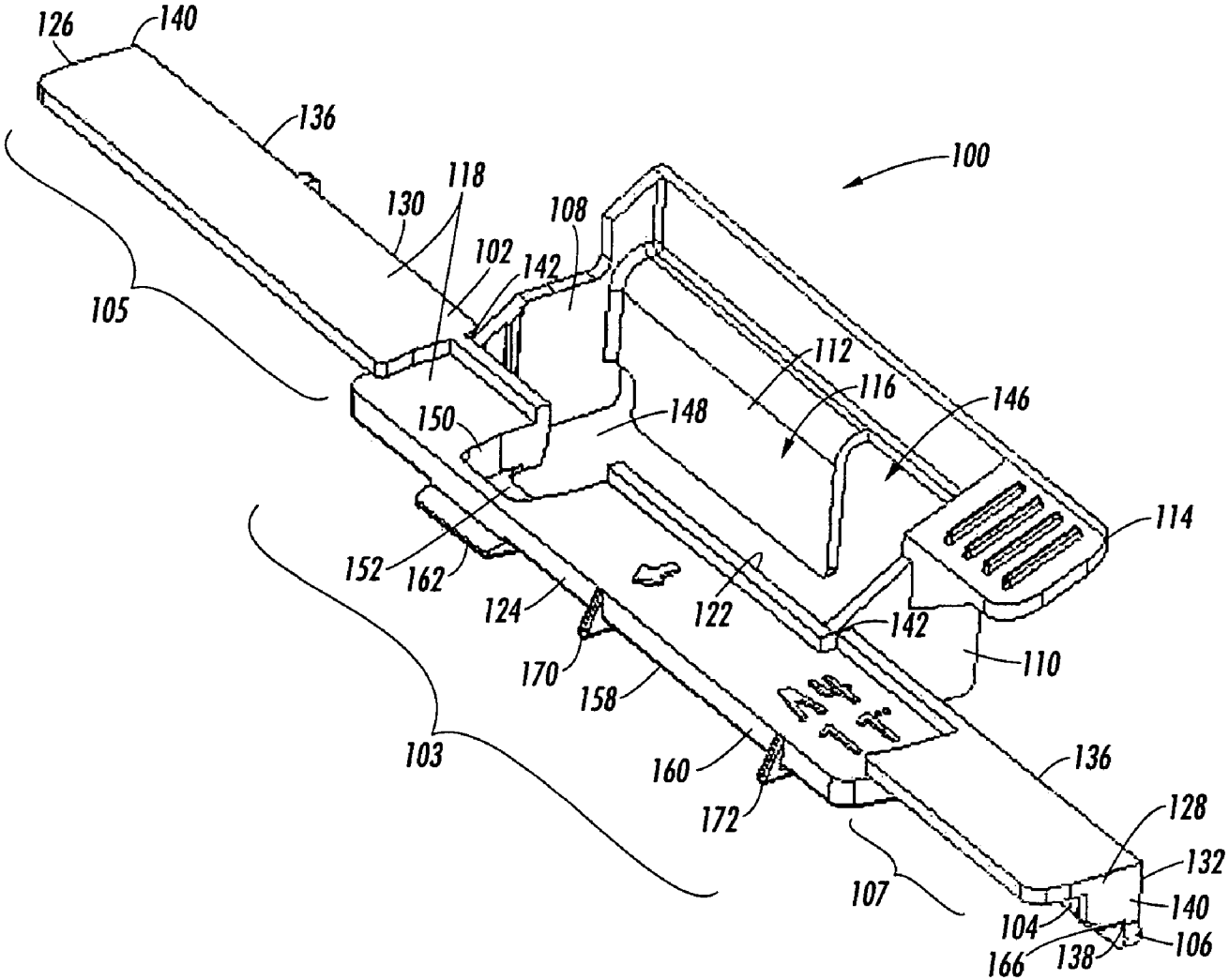
FIG. 5 is a perspective view of the tab guide of FIG. 3.
Figure 6:
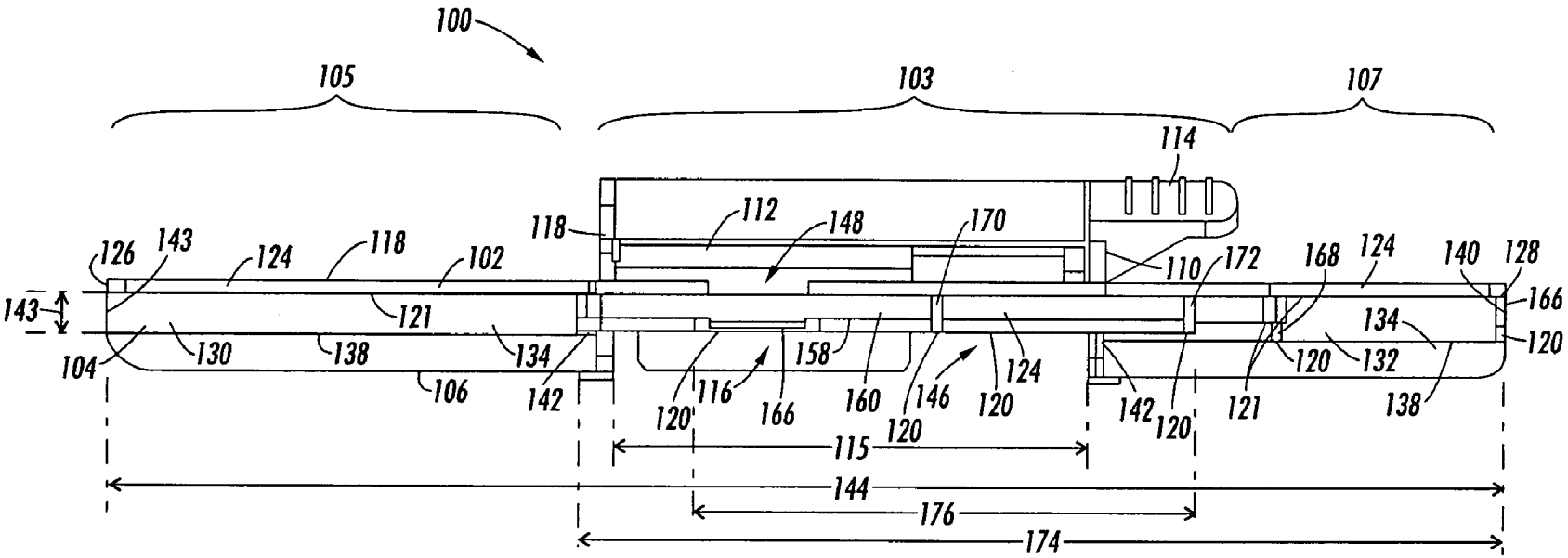
FIG. 6 is a front elevation view of the tab guide of FIG. 5.
Figure 7:
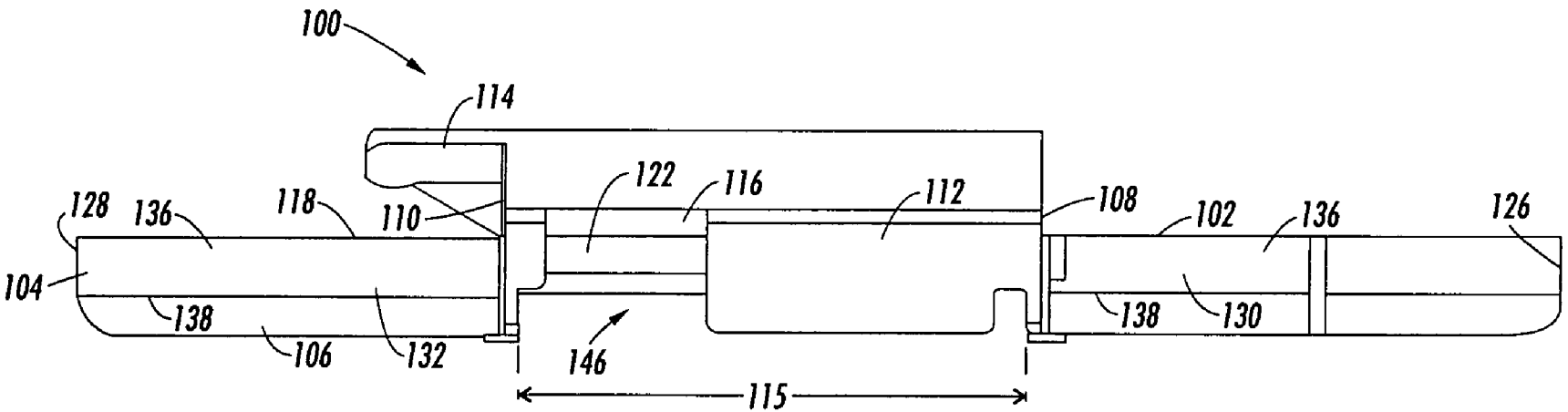
FIG. 7 is a rear elevation view of the tab guide of FIG. 5.
Figure 8:
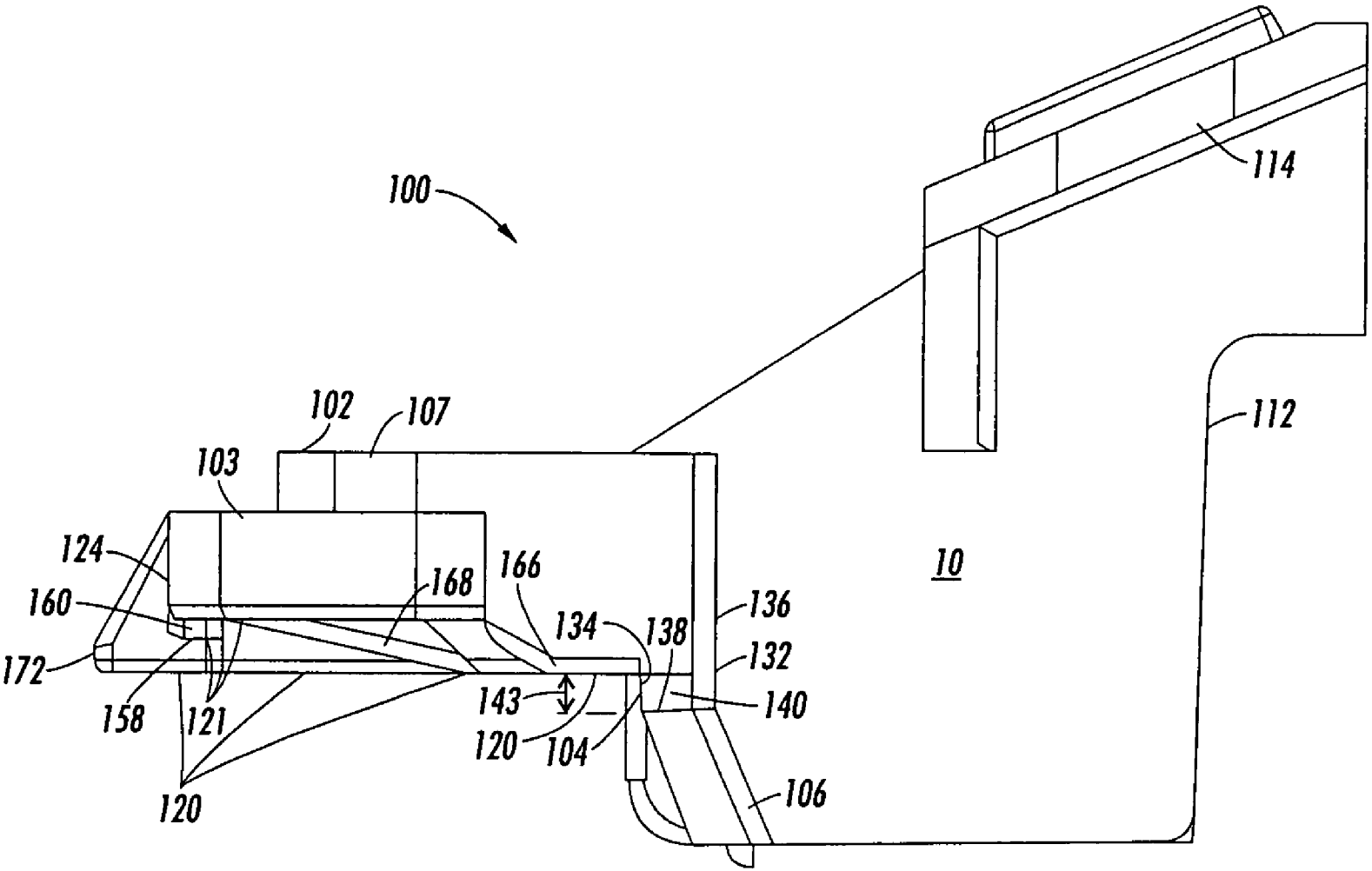
FIG. 8 is an end elevation view of the tab guide of FIG. 5.
Figure 9:
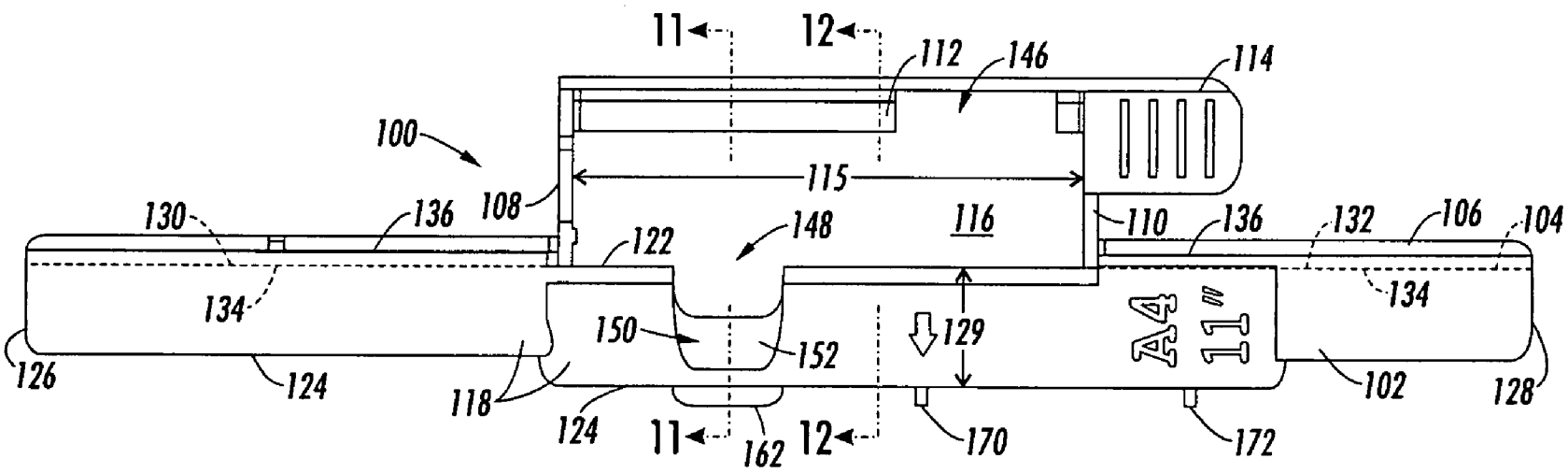
FIG. 9 is a top plan view of the tab guide of FIG. 5.
Figure 10:
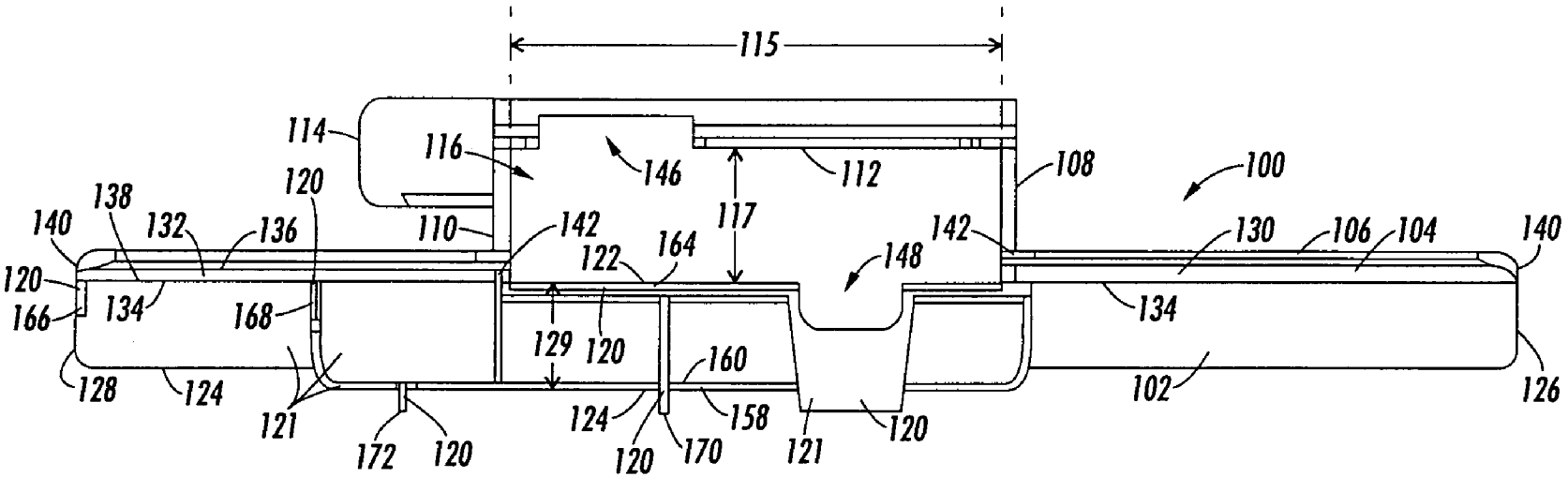
FIG. 10 is a bottom plan view of the tab guide of FIG. 5.
Figure 11:
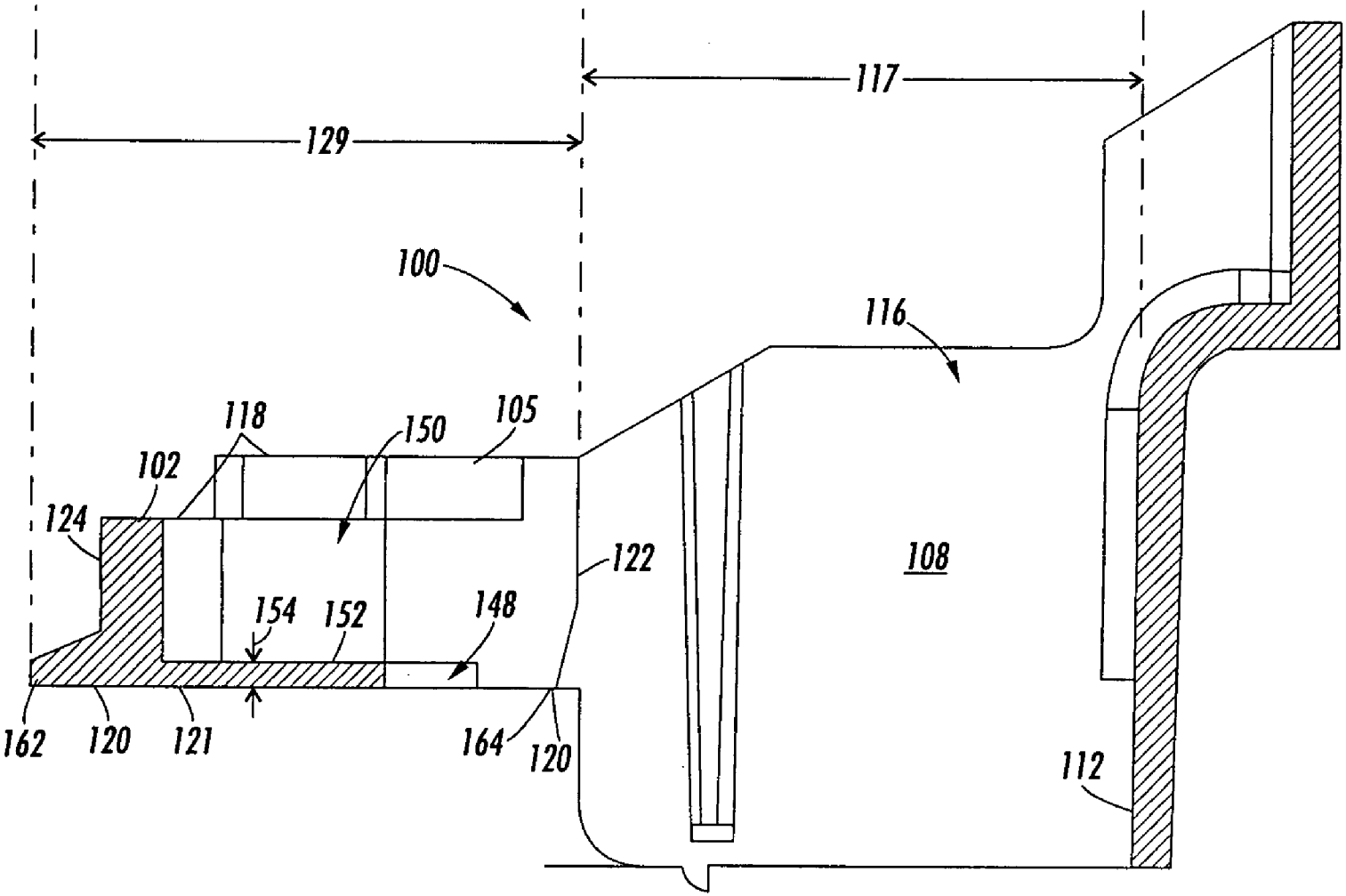
FIG. 11 is a sectional view taken along line 11-11 of the tab guide of FIG. 9.
Figure 12:
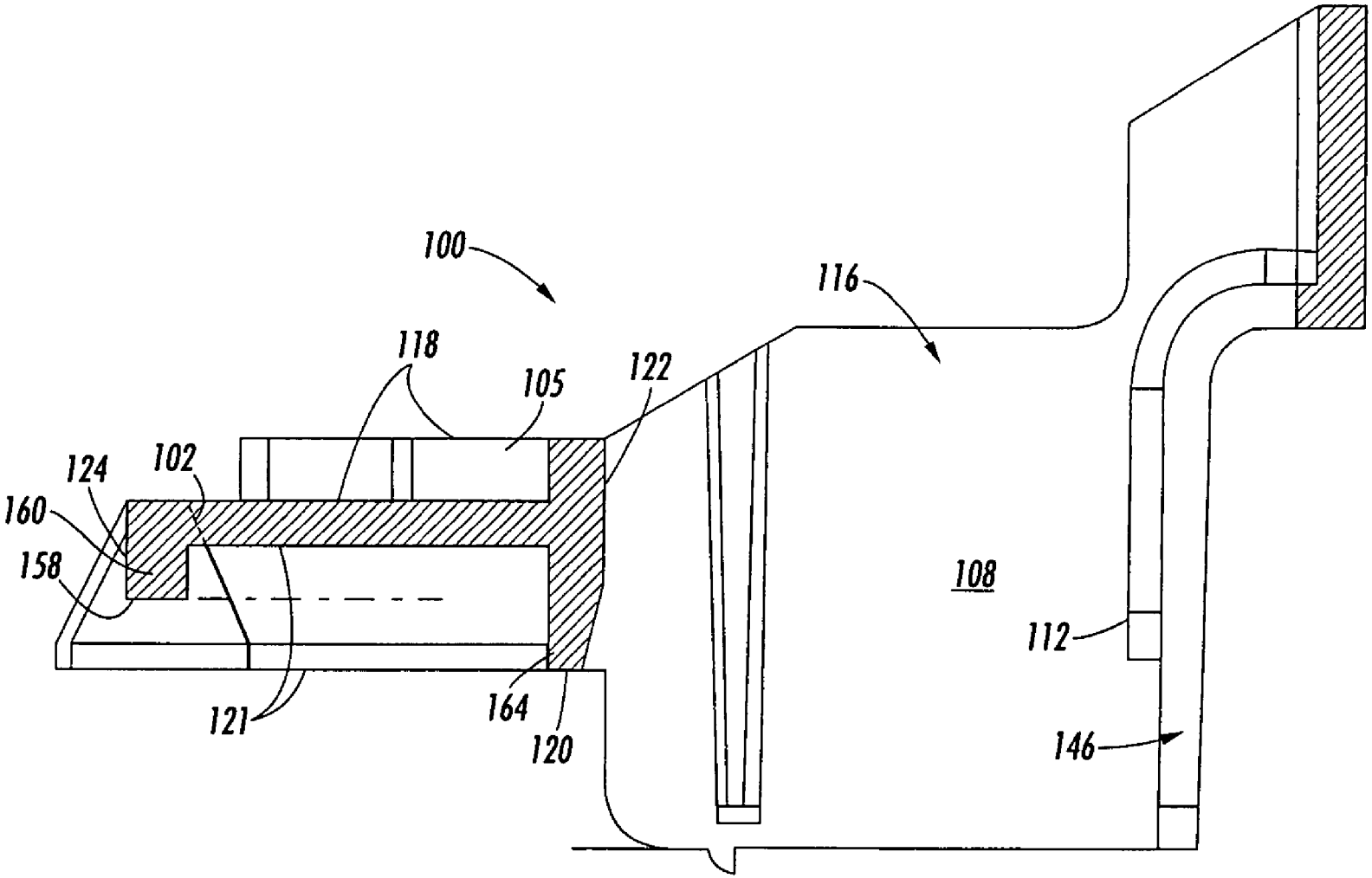
FIG. 12 is a sectional view taken along line 12-12 of the tab guide of FIG. 9.
Figure 13:
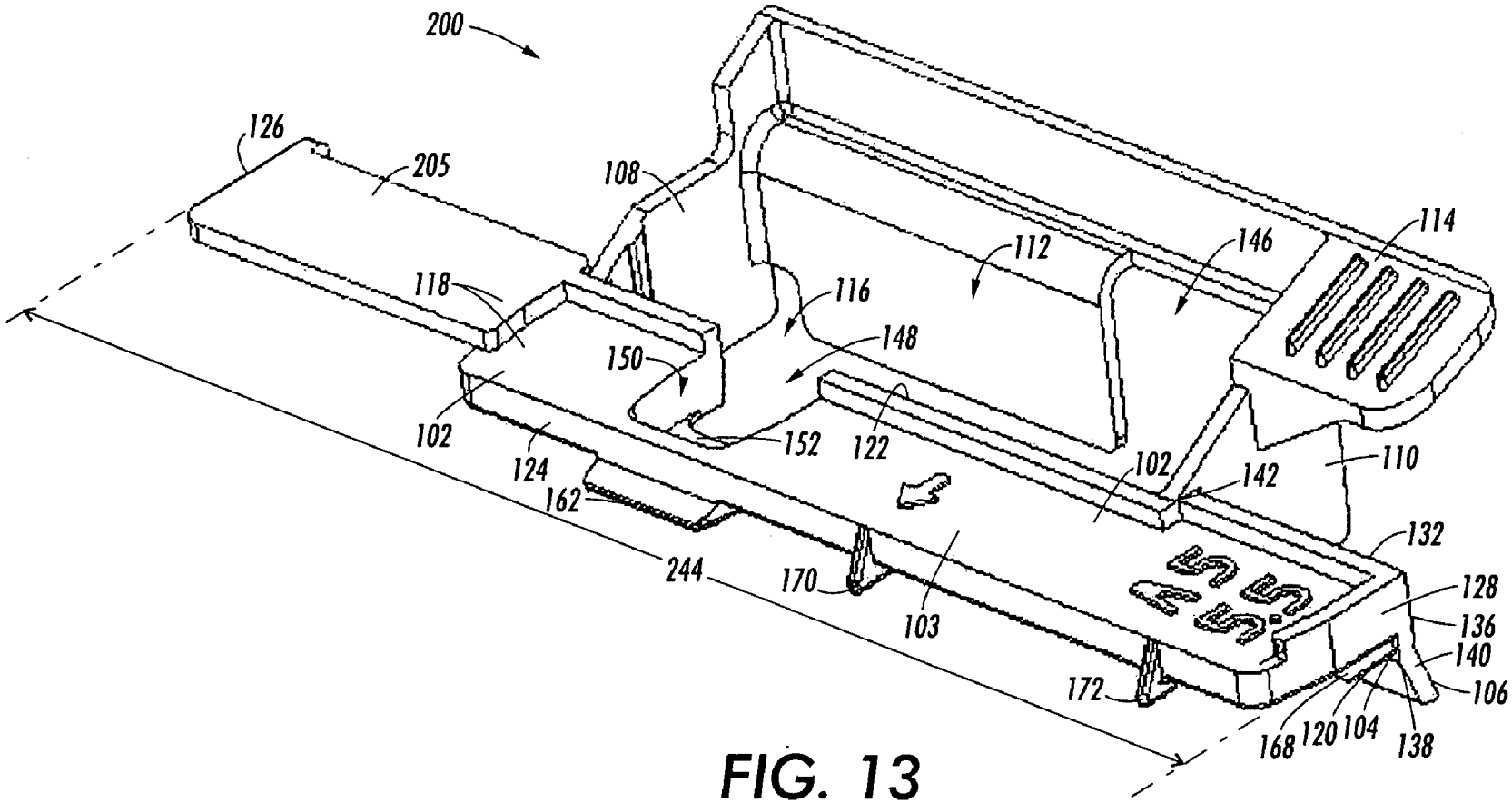
FIG. 13 is a perspective view of a second embodiment of a guide for tab stock configured to handle shorter tab stock but otherwise similar to the guide for tab stock of FIG. 5.

The disclosed tab guides 100, 200 improve the feeding of tab stock 101 from the paper tray 86. Referring to FIGS. 5 and 13, two embodiments of a tab guide 100, 200 are shown. The first embodiment of a tab guide 100 (FIG. 5) is configured to be utilized with tab stock 101 for separating A4 (8.27×11.69 in, 210×297 mm) or letter (8.5×11 in, 216×279 mm) paper and in one specific embodiment is labeled A4/11". The first embodiment of a tab guide 100 is also configured to be utilized with tab stock 101 for separating standard 9.5×11 in. paper. The second embodiment of tab guide 200 (FIG. 10) is configured to be utilized with tab stock 101 for separating A5 (5.85×8.27 in, 148×210 mm) or statement (5.5×8.5 in, 140×216 mm) paper and in one specific embodiment is labeled A5/5.5". The second embodiment of tab guide 200 may also be utilized with five tab tab stock 101 for separating A4 (8.27×11.69 in, 210×297 mm) or letter (8.5×11 in, 216×279 mm) paper within the scope of the disclosure. These tab guides 100, 200 may be removably mounted to the printer 8 at a convenient location for access by an operator loading the paper tray 86, such as, for example, on brackets or in a molded pocket that is located inside the feed module front door.

Since the first and second embodiments of tab guide 100, 200 are very similar except for their length 144, 244 which is proportioned to accommodate the sizes of tab stock 101 with which they are to be utilized, only the first embodiment of the tab guide 100 will be described in detail. In fact, both of the illustrated tab guides 100, 200 are molded in the same mold. When tab guide 100 is formed the entire cavity of the mold receives the plastic from which the tab guide is formed. When the smaller tab guide 200 is formed 42 mm of the mold cavity at each end is blocked from receiving plastic so that the first wing 105 is shortened and the second wing 107 is eliminated. Those skilled in the art will recognize that the description of the first tab guide 100 is generally applicable to the second embodiment of tab guide 200 except for the length 144, 244 of the tab guide. Thus, identical reference numerals will be utilized in referring to identical parts of the tab guides 100, 200 and similar reference numerals will be utilized in referring to different but similar parts of the tab guides 100, 200.

Referring to FIGS. 5-12, the first embodiment of a tab guide 100 is shown. The tab guide 100 includes a top flange 102, a trailing edge flange 104, a reinforcing rib 106, a first side edge guide-engaging wall 108, a second side edge guide-engaging wall 110, a rear edge guide-engaging wall 112, and a handle 114. Portions of the top flange 102 and the first side edge guide-engaging wal 108, the second side edge guide-engaging wall 110, and the rear edge guide-engaging wall 112 cooperate to form a trail edge guide-receiving aperture 116. The trail edge guide-receiving aperture 116 serves as a mount for removably mounting the tab guide 100 to the trail edge guide 90. Other structures acting as mounts for mounting the tab guide 100 to the trail guide 90 are within the scope of the disclosure.

The handle 114 extends outwardly away from the aperture 116 from the second side edge guide-engaging wall 110 to provide a convenient location for an operator to grasp the tab guide 100 during mounting to the trail edge guide 90. In the illustrated embodiments the handle 114 is a plate that is formed to include ribs on the upper surface and the upper and lower surfaces of the palate are formed at an angle relative to the top flange 102. The handle 114 is mounted at that angle to make the counter-clockwise (from the front of the tray 86) rotation of the tab guide 100 required during removal of the tab guide 100 from the trail edge guide 92 more ergonomic.

Figure 3:
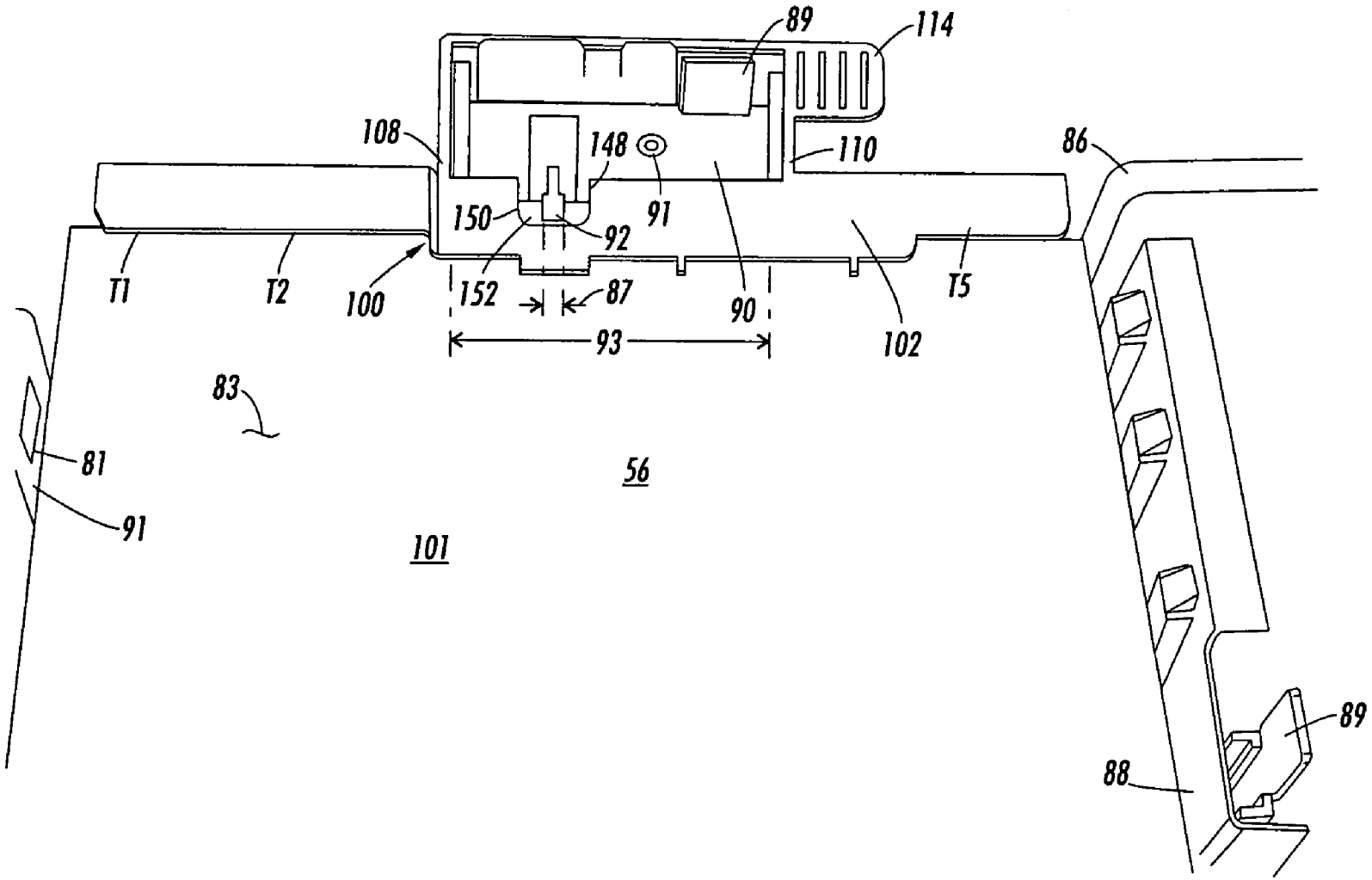
FIG. 3 is a perspective view of a paper tray disposed in one of the drawers of the printer of FIG. 1 showing a first embodiment of the disclosed tab guide mounted on a trail edge guide that includes a stack height finger and a tab stock set loaded as a stack in the paper tray.
Figure 14:
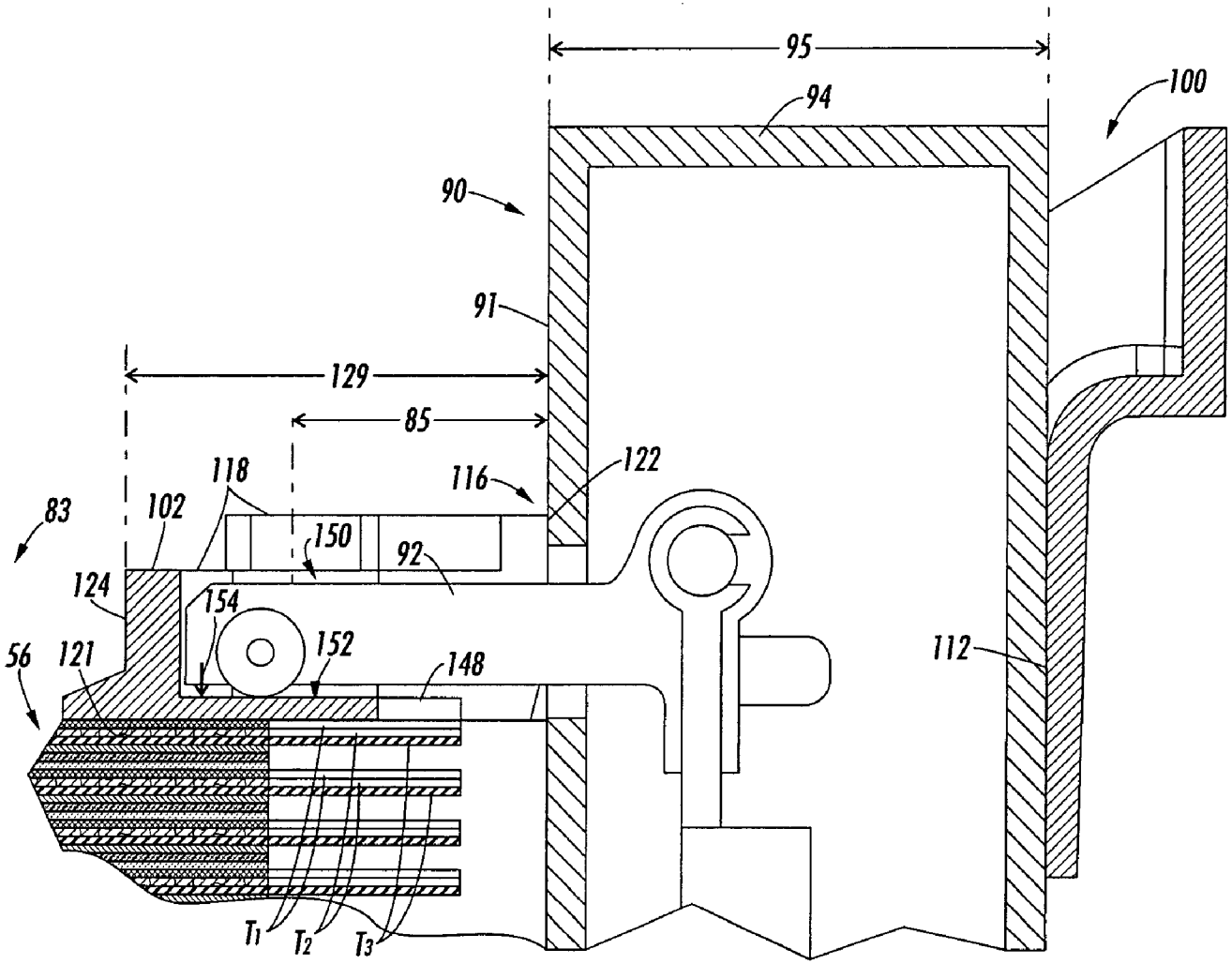
FIG. 14 is a sectional view of the tab guide mounted to the trail edge guide that includes a stack height finger of FIG. 3.
Figure 15:
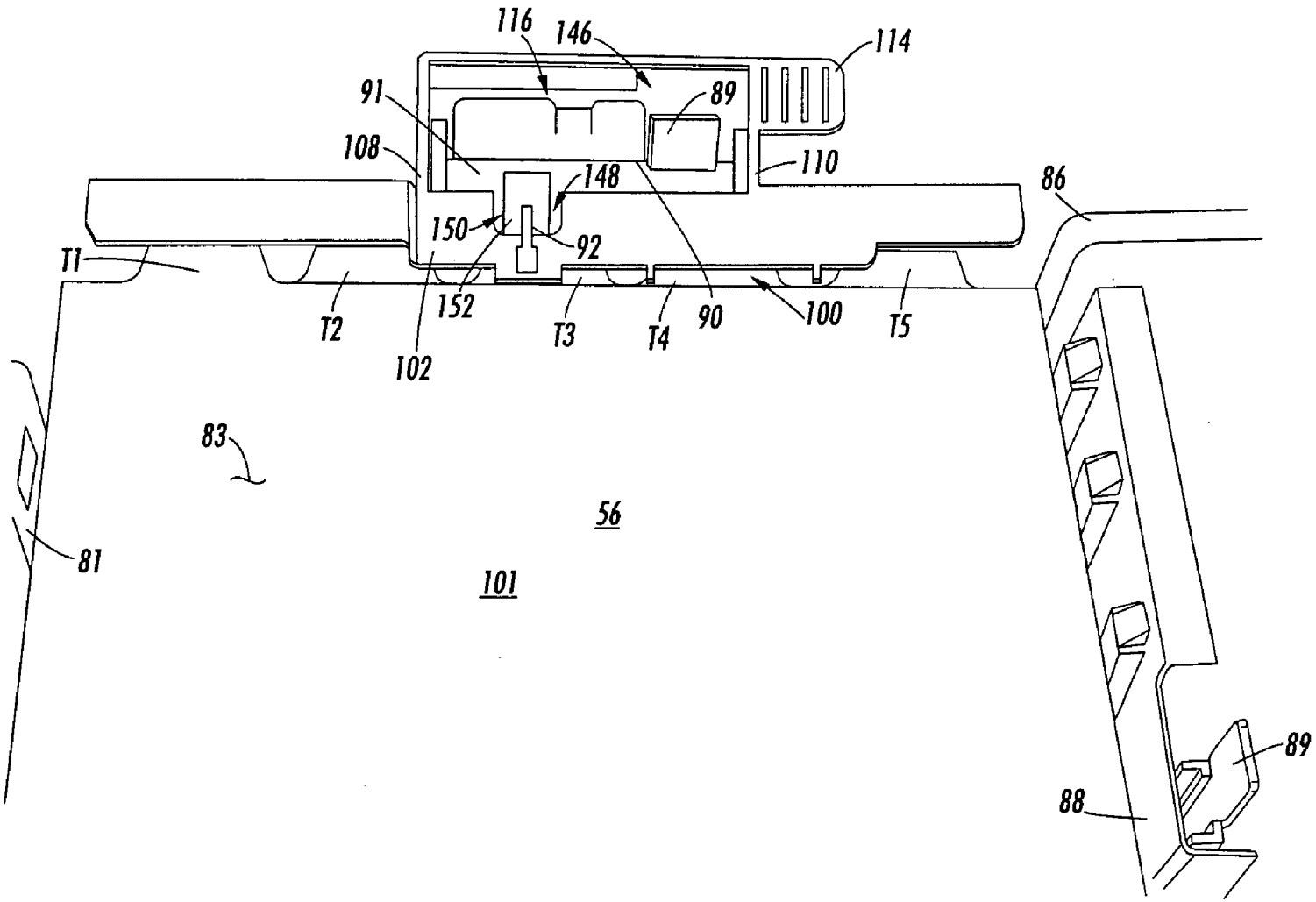
FIG. 15 is a perspective view of one step in mounting the guide for tab stock to the trail edge guide that includes a stack height finger.

The trail edge guide-receiving aperture 116 is sized to receive portions of the trail edge guide 90 therethrough to facilitate mounting the tab guide 100 to the trail edge guide 90 of the paper tray 86, as shown, for example, in FIGS. 3, 14 and 15. Thus, the trail edge guide-receiving aperture 116 has a length 115 and a width 117. The length 115 is slightly greater than the width 93 of the trail edge guide 90. The width 117 is slightly greater than the depth 95 of the trail edge guide 90. Thus, aperture 116 has a shape conforming to the horizontal cross-sectional shape of the trail edge guide 90 so that the tab guide 100 can be positioned to receive the trail edge guide 90 in the trail edge guide-receiving aperture 116 and slid vertically relative to the trail edge guide 90.

The top flange 102 includes a top surface 118, a bottom surface 121, a proximal wall 122, a distal wall 124, a first end wall 126, and a second end wall 128. The top surface 118 is spaced apart from and positioned opposite to the bottom surface 121. Only portions of the bottom surface 121 are designed to engage the top sheet of tab stock 101 in a stack 56 received in the sheet-receiving region 83 of the paper tray 86 when the tab guide 100 is properly mounted to the trail edge guide 92. Each of those portions is referred to as a sheet-engaging surface 120. The other bottom surfaces 121 that are not sheet-engaging surfaces 120 act as upward motion restrictors that restrict the tabs of the tab stock 101 from being blown vertically too far by the fluffers 96, 98 during sheet acquisition.

In the disclosed embodiment sheet-engaging surfaces 120 are formed on the bottom surfaces 121 of a central plate 162, a proximal lip 164, a second end rib 166, a central portion second end wall 168, a lateral central rib 170 and a short rib 172. The bottom surfaces 121 of the central plate 162, the proximal lip 164 and the second end rib 166 are substantially planar except for a radius formed along the edges to reduce marking of stock lying thereunder. Thus, the substantially planar surfaces of the bottom surfaces 121 of the central plate 162, the proximal lip 164 and the second end rib 166 are sheet-engaging surfaces 120. The lateral central rib 170 and the short rib 172 are both very thin (about 2 mm wide) and are fully radiused along the edges so that only the central portion of the bottom surface 121 of the lateral central rib 170 and the short rib 172 are sheet-engaging surfaces 120. The central portion second end wall 168 angles upwardly from the bottom of the proximal lip 162 to the bottom surface 121 of the second end of the central portion 103. Thus, only a very small portion of the central portion second end wall 168 adjacent the proximal lip is a sheet-engaging surface 120. The lateral central rib 170, short rib 172 and central plate 162 all include portions of their sheet-engaging surfaces 120 that extend in the process direction away from the distal end wall 124 of the top flange 102. All of the sheet-engaging surfaces 120 are coplanar.

Except for the lateral central rib 170, short rib 172 and central plate 162, the distal end wall 124 extends between and couples the distal edge of the top surface 118 and the distal edge of the bottom surface 121. The proximal end wall 122 extends between and couples the proximal edge of the top surface 118 and the proximal edge of the bottom surface 121. The first end wall 126 extends between and couples the first end of the top surface 118 to the first end of the bottom surface 121. The second end wall 128 extends between and couples the second end of the top surface 118 to the second end of the bottom surface 121.

The proximal end wall 122 of top flange 102 is generally perpendicular to the sheet-engaging surfaces 120 of the central plate 162, the proximal lip 164, the second end rib 166, the central portion second end wall 168, the lateral central rib 170 and the short rib 172. Thus, when the sheet-engaging face 91 of the trail edge guide 90 engages that portion of the proximal end wall 122 that defines one wall of the trail edge guide-receiving cavity 116, the sheet-engaging surfaces 120 of the top flange 102 are maintained perpendicular to the tab engaging face 91 of the trail edge guide 90. In the illustrated embodiment, the surface-engaging faces 120 are maintained in a substantially horizontal position when the tab guide 100 is received on the trail edge guide 90.

The distal ends of the lateral central rib 170, short rib 172 and central plate 162 of the top flange 102 are each displaced from the portion of the proximal wall 122 that forms a wall of the aperture 116 by a displacement 129. In the illustrated embodiment, displacement 129 is approximately 24 millimeters. Thus, when the tab guide 100 is properly mounted to the trail edge guide 90, the distal ends of the lateral central rib 170, short rib 172 and central plate 162 of the top flange 102 extend by the displacement 129 away from the sheet-engaging face 91 of the trail edge guide 90.

In other areas adjacent the ends of the illustrated top flange 102, the distal wall 124 does not extend as far in the process direction but still extends sufficiently in the process direction to be overlying the tabs T1-T5 of tab stock 101 in the sheet stack 56 and a portion of the uneven edge adjacent the even marginal edge. Except for the sheet-engaging surfaces 120, these portions of the bottom surface 121 of the flange are displaced slightly above the top sheet of tab stock 101 when the tab guide 100 is properly mounted to the trailing-edge guide. Such portions of the bottom surface 121 may engage and restrain the upward movement of the top sheet of the sheet stack 56 when the fluffer is in operation.

The trailing edge flange 104 comprises two flange portions 130, 132 positioned on opposite sides of the trail edge guide-receiving aperture 116. Each portion of the trailing edge flange 104 includes a trailing edge-engaging surface 134, a rear surface 136, a bottom wall 138, a distal end wall 140 and a proximal end 142. The trailing edge-engaging surface 134 of each flange portion 130, 132 is substantially planar and is oriented to be substantially perpendicular to the sheet-engaging surfaces 120 of the top flange 102. The bottom wall 138 of each flange portion 130, 132 extends between and couples the bottom edges of the trailing edge-engaging surface 134 and the rear surface 136 of its associated flange portion 130, 132. The distal end wall 140 of the first flange portion 130 extends between and couples the distal ends of the trailing edge-engaging surface 134 and the rear surface 136 of the first flange portion 130. The distal end wall 140 of the second flange portion 132 extends between and couples the distal ends of the trailing edge-engaging surface 134 and the rear surface 136 of the second flange portion 132. The proximal end of the first flange portion 132 is mounted to the first side edge guide-engaging arm 108 at a position and orientation to maintain the trailing edge-engaging surface 134 of the first flange portion 132 in the same plane as the sheet-engaging face 91 of the trail edge guide 90.

The bottom edge 138 of the trailing edge-engaging surface 134 is displaced by a width 143 from the sheet-engaging surfaces 120 of the top flange 102. In the illustrated embodiment, the width 143 is approximately between 7.5-10 millimeters depending on the position along the length of the tab guide 100. The width 143 of the trailing edge-engaging surface 134 is such that when the sheet-engaging surfaces 120 of the top flange 102 are in engagement with the top sheet of tab stock 101 in the sheet stack 56, the trailing edge-engaging surface 134 engages the trailing edge of the tabs on the top several sheets of tab stock 101 in the stack 56.

In the illustrated embodiment, the reinforcing rib 106 extends at an angle rearwardly from the bottom wall 138 of each portion 130, 132 of the trailing edge flange 104. The reinforcing rib 106 acts to maintain the trailing edge-engaging surface 134 of the trailing edge flange 104 substantially planar. The slanted front face of the reinforcing rib 106 also facilitates realigning slightly misaligned tab stock 101 as the elevator plate 83 raises the tab stock 101 toward the tab guide 100.

In the illustrated embodiment, the first end wall 126 of the top flange 102 is co-planar with the distal end wall 140 of the first flange portion 130 of the trailing edge flange 104. Similarly, the second end wall 128 of the top flange 102 is co-planar with the distal end wall 140 of the second flange portion 132 of the trailing edge flange 104. Thus, the tab guide 100 can be considered to have a length 144 measured between the first end wall 126 and second end wall 128 of the top flange 102 or alternatively between the distal end walls of the first and second flange portions 130, 132 of the trailing edge flange 104. In the illustrated embodiment, the length 144 of tab guide 100 is approximately 10.5 inches (266 mm) to facilitate usage of the tab guide 100 with tab stock 101 for separating A4 paper (210×297 mm) and letter (8.5×11") paper. Those skilled in the art will recognize that the length 244 of tab guide 200 is proportioned to accommodate usage of tab guide 200 with A5 (148×210 mm) paper and statement paper (5.5×8.5"). Thus, in the illustrated embodiment, the length 244 of tab guide 200 is approximately 7.13 inches (181 mm).

In use, tab stock 101 is loaded into the paper tray 86 and the appropriately sized tab guide 100, 200 for the tab stock 101 being loaded is mounted on the trail edge guide 90. The trail edge guide 90 is received in the trail edge guide-receiving aperture 116 and the tab guide 100, 200 is positioned so that the stack height finger 92 engages the top surface 118 of the top flange 102 of the tab guide 100, 200.

Since, in the illustrated embodiment the rear guide-engaging arm 112 is generally parallel to, and spaced apart by width 117 from the proximal wall 122 of the top flange 102 and the first side edge guide-engaging arm 108 is generally parallel to, and spaced apart by length 115 from the second side edge guide-engaging arm 110 and the trail edge guide 90 has a width 93 and a depth 95, the proximal wall 122 of the top flange 102 is constrained to be parallel to the sheet-engaging face 91 of the trail edge guide 90 when the guide 90 is received in the aperture 116. Because the sheet-engaging surfaces 120 are generally perpendicular to the proximal wall 122 of the top flange 102, the sheet-engaging surfaces 120 are perpendicular to the sheet-engaging face 91 of the trail edge guide 90 when the trail edge guide 90 is received in the aperture 116 of the tab guide 100, 200. Consequently, since the trailing edge-engaging surface 134 is perpendicular to the sheet-engaging surfaces 120, the trailing edge-engaging surface 134 is parallel to the sheet-engaging face 91 of the trail edge guide 90 when the trail edge guide 90 is received in the aperture 116 of the tab guide 100, 200.

As mentioned previously, the tab guide 100, 200 is configured to cause the trailing edge-engaging surface 134 of the trailing edge flange 104 to be co-planar with the sheet-engaging face 91 of the trail edge guide 90 when the guide 90 is received in the aperture 116. Thus, the trailing edge-engaging surface 134 of the trailing edge flange 104 in effect acts to extend the width 93 of the sheet-engaging face 91 of the trail edge guide 90. Due to this effective extension of the width 93 of sheet engaging face 91, the tabs on all of the top several sheets of tab stock 101 in a tab stock set in a sheet stack 56 can be engaged by either the sheet-engaging face 91 or the trailing edge-engaging surface 134 and properly aligned in the printer tray 86 when the tab guide 100, 200 is properly utilized in conjunction with the trail edge guide 90.

Similarly, since the stack height finger 92 is in engagement with the top surface 118 of the top flange 102 of the tab guide 100, 200, the top flange 102 acts to effectively extend the width 87 of the stack height finger 92 to restrict the upward movement of the top sheet in the stack along the trailing edge to facilitate fluffer operation. However, since only portions of the bottom surface 121 are actually sheet-engaging surfaces 120, the width of the sheet-engaging surface of the top flange 92 is effectively extended at most by the displacement 174 between the second end wall 166 and the first end edge of the proximal rib 164 in tab guide 100 assuming a tab on the top sheet of tab stock 101 in the stack is underlying the second end wall 166. The width of the sheet-engaging surface of the top flange 102 is effectively extended at most by the displacement between the central portion second end wall 168 and the first end edge of the proximal rib 164 in tab guide 200 assuming a tab on the top sheet of tab stock 101 in the stack is underlying the central portion second end wall 168. At a minimum, the width of the sheet-engaging surface of the top flange 92 is effectively extended by the displacement 176 between the short rib 172 and the first end edge of the central plate 162.

Due to this effective extension of the width 87 of the stack height finger 92, any tab regardless of its location along the uneven edge of the tab stock 101 on the top sheet of tab stock 101 in a tab stock set in a sheet stack 56 can be engaged by the bottom surface 121 and restrained (although not necessary held in its original location) in the printer tray 86 when the tab guide 100, 200 is properly utilized in conjunction with the trail edge guide 90.

Figure 4:
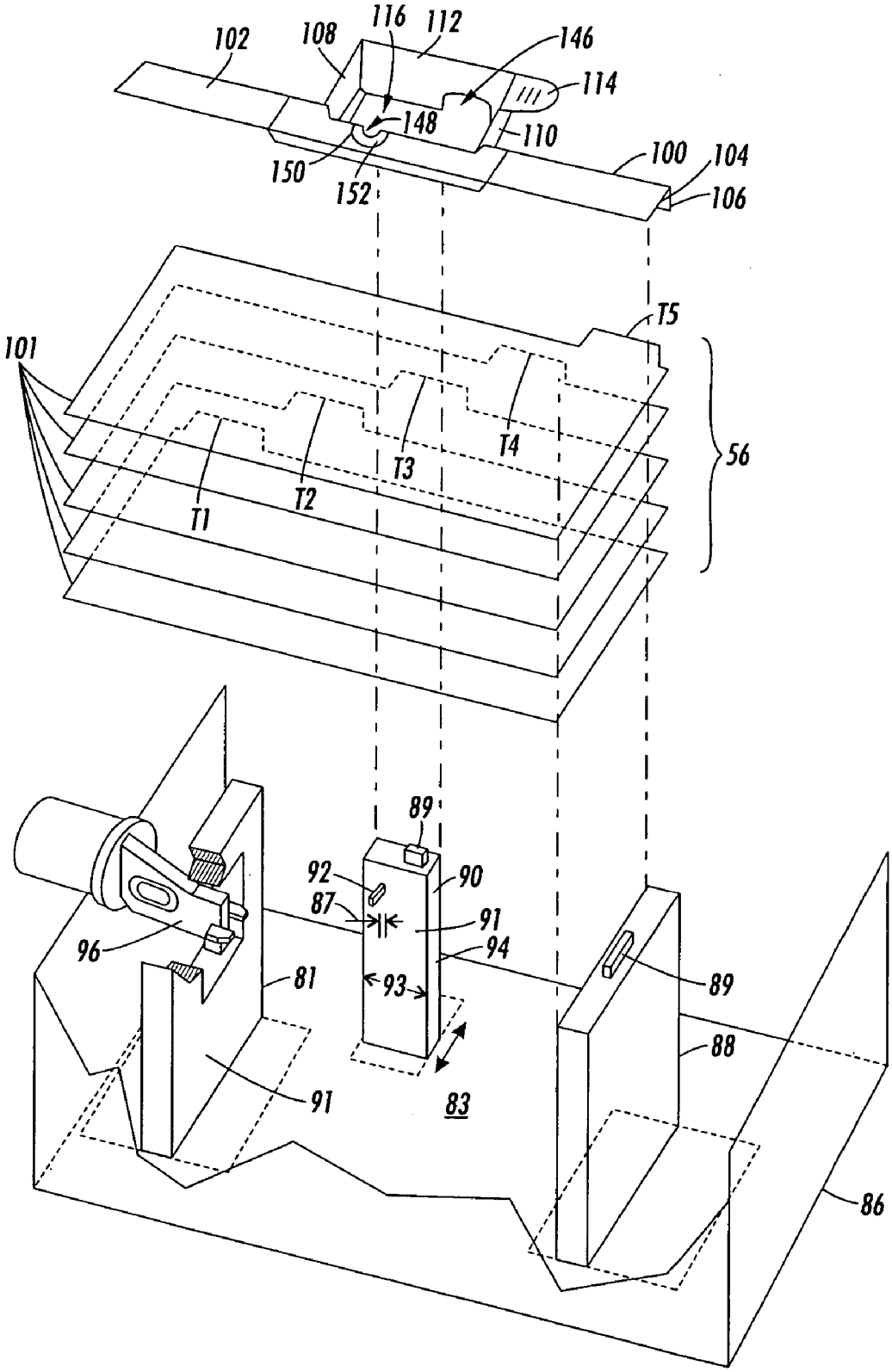
FIG. 4 is an exploded view with parts broken away of the paper tray, trail edge guide, two end edge guides one of which is configured to allow an air knife to blow air between upper sheets on the stack, a stack of five sheets of tab stock and the tab guide of FIG. 3.

As shown in FIG. 4, the translating fluffer assembly 96 blows air between the sheets in the stack from the rear of the paper tray 86. This air tend to travel the length of the stack and can cause significant fluttering of tab stock 101 that has its tab located adjacent the front of the paper tray 86. The second end wall 166 which includes a sheet engaging surface 120 extends a short distance in the process direction from the trailing edge-engaging surface 134 of the trailing edge flange 104. The second end wall 166 is placed adjacent the front of the paper tray 86 when the tab guide 100 is mounted to the trail edge guide 90. Tabs underlying the second end wall 166 are engaged by the second end wall and held in their original location when the air knife and fluffer blow air between the sheets in the stack 56 to significantly reduce or eliminate the above described fluttering.

At least those portions of the top sheet of tab stock 101 in a tab stock set in a sheet stack 56 underlying the central lateral rib 170, short rib 172 and central plate 162 are engaged by their sheet-engaging surfaces 120 and restrained and held in their original location in the printer tray 86 regardless of the location of the tab along the uneven edge when the tab guide 100, 200 is properly utilized in conjunction with the trail edge guide 90. This is because the distal ends of the central lateral rib 170, short rib 172 and central plate 162 are displaced in the process direction from the sheet-engaging face 91 of the trailing-edge guide 90 by a displacement 129 (illustratively 24 mm) greater than the width (9-14 mm) of standard tabs on tab stock 101. Thus, portions of the sheet-engaging surfaces 120 of the central lateral rib 170, short rib 172 and central plate 162 engage at least 10-15 mm of the underlying portions of the top surface of the top sheet of typical tab stock 101 adjacent the trailing edge regardless of where the tab is located along the uneven edge. Consequently, the sheet-engaging surfaces 120 of the central lateral rib 170, short rib 172 and central plate 162 of the top flange 102 act to effectively extend the length (illustratively 14 mm) of the stack height finger 92 to the displacement 129.

While the above description of tab guide 100 suffices to describe the general concept of the disclosed tab guide, the illustrated tab guides 100, 200 include additional features that facilitate usage of the guides with the disclosed trail edge guide 90. In particular, the rear guide engaging arm 112 is formed to include a handle assembly opening 146. The handle assembly opening 146 is sized to facilitate passing the movement handle assembly 89, which extends vertically above the top of the trail edge guide 90, therethrough during removal of the tab guide 100, 200 from the trail edge guide 90.

The top surface 118, bottom surface 120 and proximal wall 122 of the top flange 102 of the tab guide 100, 200 are also formed to include a U-shaped channel 148 opening into the aperture 116 to facilitate passage of the tab guide 100, 200 over the stack height finger 92 as the tab guide 100, 200 is being mounted to the trail edge guide 90. Also, in the illustrated embodiments, the top surface 118 of the tab guide 100, 200 includes a depression 150 having an upwardly facing surface 152 adjacent the U-shaped channel 148. The bottom of the stack height finger 92 engages and rides on the upwardly facing surface 152 of the depression 150 formed in the top surface 118 of the top flange 102. In the illustrated embodiment, the upwardly facing surface 152 of the depression 150 is generally parallel to, and spaced apart by a displacement 154 from, the sheet-engaging surface 120 of the central plate 162 disposed thereunder. In the illustrated embodiment, the displacement 154 is approximately one millimeter.

Since all of the sheet-engaging surfaces 120 of the tab guide 100 are coplanar, they are all displaced vertically below the upwardly facing surface 152 of the depression 150 by displacement 154. Thus, when the top sheet in a tab stock stack 56 engages the sheet-engaging surfaces 120 of the top flange 102 the stack height finger 92 senses the height of the stack inaccurately because a portion of the top flange 102 is disposed between the stack height finger 92 and the top sheet of the tab stock 101. The depression 150 is formed to minimize this error. Preferably, this error is within the operating tolerances of the feed system 58.

When the disclosed tab guides 100, 200 are utilized in a paper tray 86 of a printer 8, the printer 8 generally operates in the same fashion as when standard sheets are utilized. The print job is programmed using the UI 14 as it normally would be for operation utilizing tab stock 101 including programming of tab stock 101 as either the main body of the job or as special pages or inserts. Printers 8 generally identify tab stock 101 as a particular type of sheet stock due to special registry requirements for images to be printed on the tabs of the tab stock 101. The drawer 11 containing the paper tray 86 is then opened and paper stock is removed, if required. The side and edge guides 81, 88, 90 are preferably moved to the open position by actuating the movement handle assembly 89 and sliding the guides 81, 88, 90 away from the sheet-receiving area 83 of the tray 86 in order to accommodate the size of the tab stock 101 to be utilized.

In the illustrated embodiment, the uneven edges of the tab stock 101 are placed adjacent the trail edge guide 90 of the paper tray 86. The even edge of the tab stock 101 is positioned against the leading edge of the tray 86. The edge guides 81, 88, 90 are then moved into engagement with the tab stock 101 in the paper tray 86 if they had been previously opened. Preferably, the trail edge guide 90 is positioned against the stack 56 before positioning the front and rear side guides 88, 81. Care should be used when positioning the trail edge guide 90 against the trailing edge of the tab stock 101 to prevent damage to the tabs.

Preferably, the operator manually adjusts the entire stack 56 of tab stock 101 in an attempt to ensure that the trailing edges of all of the tabs are positioned generally in the same plane as the sheet-engaging face 91 of the trail edge guide 90. Any misaligned tabs are manually adjusted. Because the tab guide 100, 200 prevents the stack height finger 92 from engaging the top surface of the top sheet of the stack, tab stock 101 is preferably loaded to a level slightly below the maximum level of sheets that the paper tray 86 was configured to accommodate. In the illustrated embodiment, it is recommended that the tab stock 101 be loaded so that the top sheet in the stack 56 is at least one-half inch below the maximum fill level of the tray 86. This "short stacking" permits the tab guide 100, 200 to be rotated as described below to place the stack height finger 92 on the upwardly facing surface 152 of the depression 150.

After the tab stock 101 has been loaded to the appropriate height in the paper tray 86 and manually aligned, the appropriate tab guide 100, 200 is removably mounted to the trail edge guide 90. The illustrated tab guides 100, 200 are configured to be stored on a bracket or molded pockets inside the feed module front door of the printer 8. Prior to use, the appropriate tab guide 100, 200 is removed from the bracket or the molded pockets on the front door. The tab guide 100, 200 is aligned with the trail edge guide 90 so that the trail edge guide 90 can be received through the guide-receiving aperture 116.

The tab guide 100, 200 is slid straight downwardly along the trail edge guide 90 with the trail edge guide 90 being received in the trail edge guide-receiving aperture, as shown, for example, in FIG. 15, so that the stack height finger 92 is depressed by the bottom surface 121 of the central plate 162 and induced to rotate downwardly. As the tab guide 100, 200 is slid further downwardly along the trail edge guide 90, the depressed stack height finger 92 passes through the U-shaped channel 148 formed in the top flange 102. After the tab guide 100, 200 passes the tip of the stack height finger 92, the spring loaded stack height finger 92 rotates toward the horizontal so that the upwardly facing surface 152 of the depression 150 is disposed under the stack height finger 92. In order to facilitate rotation of the stack height finger 92 as described, in the illustrated embodiment, it is recommended that the top sheet of the tab stock 101 in the sheet stack 56 be positioned at least one-half inch below the maximum fill level of the paper tray 86.

As shown, for example, in FIGS. 3 and 14, the top flange 102 of the tab guide 100, 200 is positioned underneath the stack height finger 92 of the trail edge guide 90. The tab guide 100, 200 is also positioned with the sheet-engaging surfaces 120 perpendicular to the sheet-engaging face 91 of the trail edge guide 90 and the trailing edge-engaging surface 134 of the trailing edge flange 104 co-planar with the sheet-engaging face 91 of the trail edge guide 90. As the elevator plate 83 in the sheet-receiving region of the paper tray 86 raises the stack 56 of tab stock 101, the upwardly facing surface 152 of the depression 150 engages the bottom of the stack height finger 92 actuating the same to control the movement of the elevator plate 83.

In the event that the tab stock 101 in the stack 56 is not properly aligned, the tab guide 100, 200 will not be able to be positioned as described above and should be at least partially removed from the trail edge guide 90. The tab stock 101 in the stack 56 is then manually realigned and the tab guide 100, 200 is again mounted to the trail edge guide 90 as described above. Once the tab guide 100, 200 is properly mounted to the trail edge guide 90, the drawer 11 including the paper tray 86 is closed slowly, but firmly, until it latches. Closure of the drawer 11 enables the elevator plate 83 to raise the stack 56 of tab stock 101 until the stack height finger 92 is engaged by the upwardly facing surface 152 of the depression 150 formed in the top flange 102 of the tab guide 100, 200 riding on the top sheet in the stack 56 which stops the elevator tray in a position wherein the top sheet of the stack 56 is positioned for subsequent acquisition by the feeder.

Figure 16:
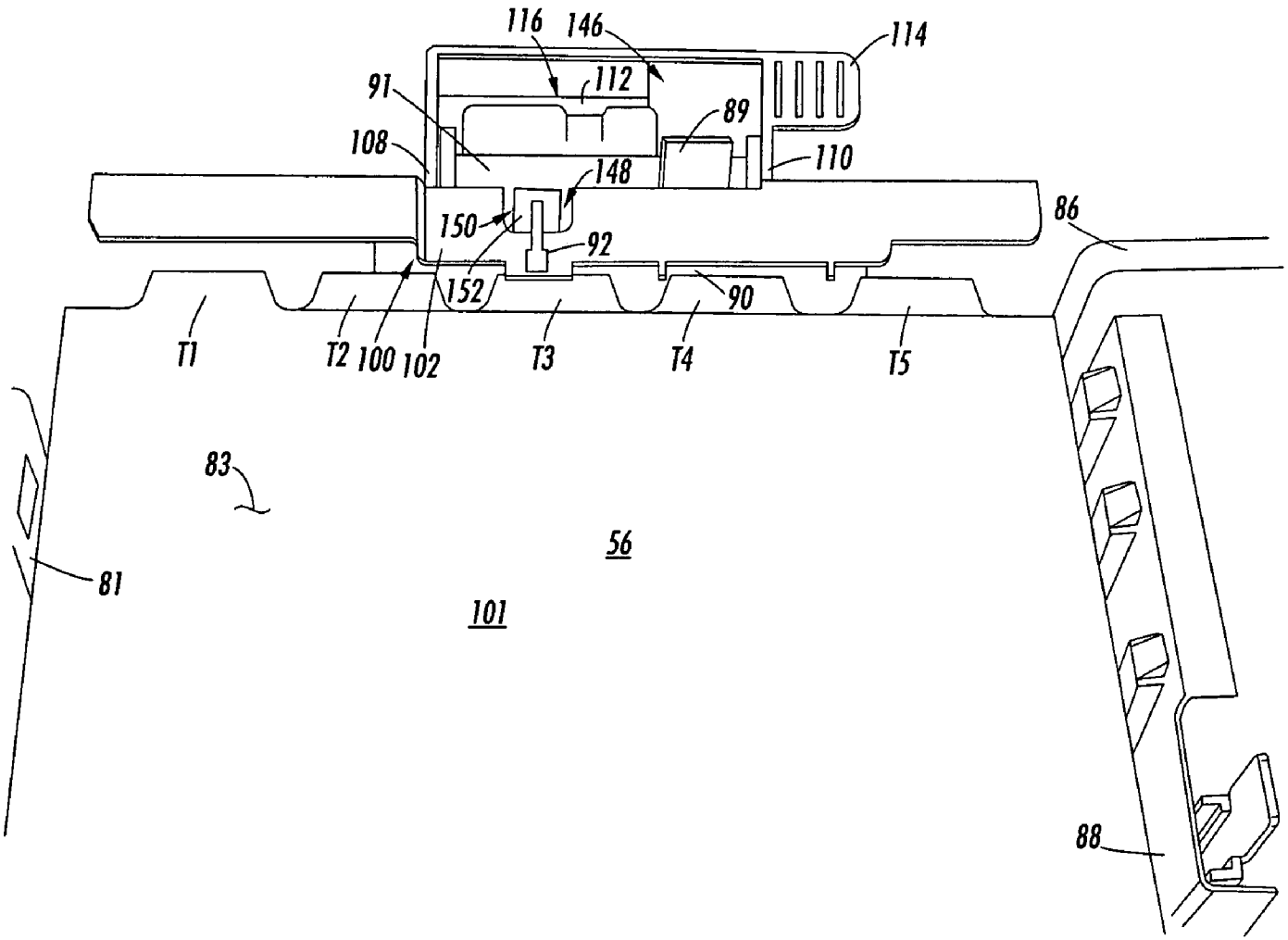
FIG. 16 is a perspective view of one step in removing the guide for tab stock from the trail edge guide that includes a stack height finger.
Figure 17:
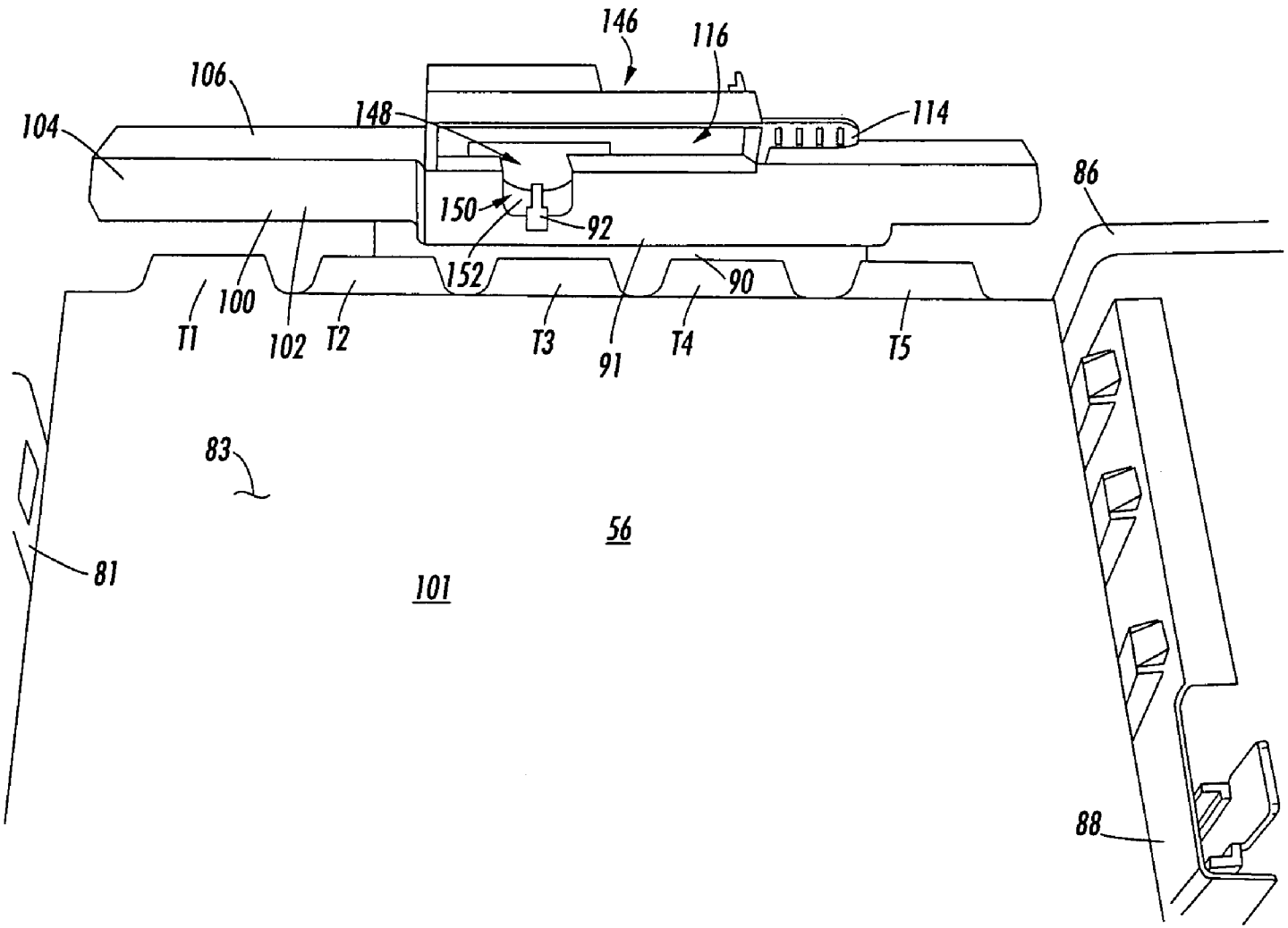
FIG. 17 is a perspective view of another step in removing the guide for tab stock from the trail edge guide that includes a stack height finger.
Figure 18:
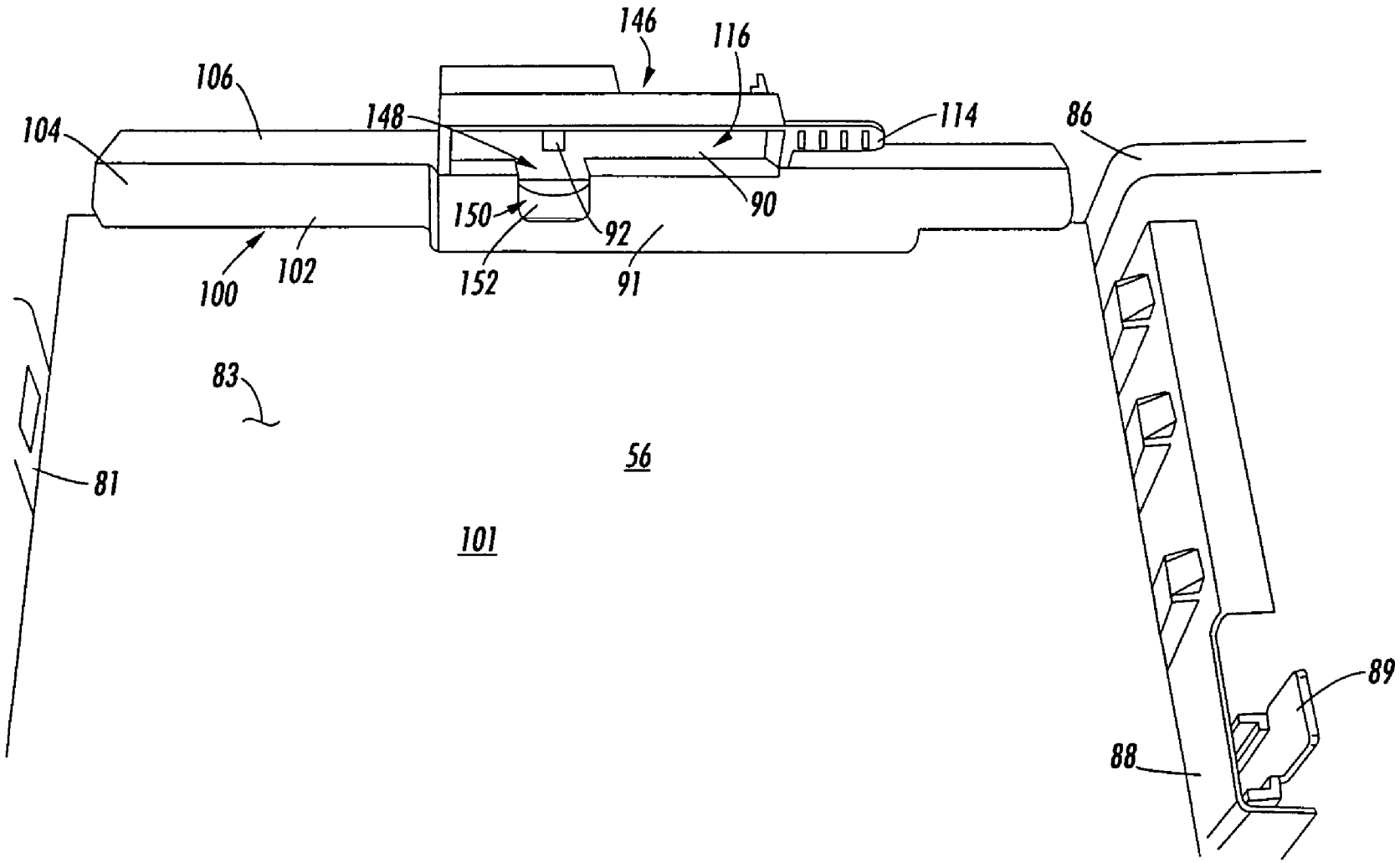
FIG. 18 is a perspective view of yet another step in removing the guide for tab stock from the trail edge guide that includes a stack height finger.

The tab guide 100, 200 should be removed from the trail edge guide 90 of the paper tray 86 once tab printing is completed to reduce the chance of damaging the tab guide 100, 200 and paper and to permit proper orientation of the sheets when loading normal paper. The tab guide 100, 200 is lifted as shown, for example, in FIG. 16, until it touches the bottom side of the stack height finger 92. The tab guide 100, 200 is then rotated forward toward the tab stock 101 to facilitate the disengaging the tab guide 100, 200 from the stack height finger 92, as shown, for example, in FIG. 17. The tab guide 100, 200 is then pushed forward having the movement actuator 87 pass through the actuator opening 146 until the stack height finger 92 is clear of the depression 150 and is free to pass through the U-shaped channel 148 formed in the top flange 102 of the tab guide 100, 200, as shown, for example, in FIG. 18. The tab guide 100, 200 may then be lifted vertically off of the trail edge guide 100, 200 and stored for later use.

The tab guide 100, 200 when properly mounted to the trail edge guide 90 prevents the fluffer from blowing tab stock 101 with short tab extensions away from the lead edge of the paper tray 86. When the tab guide 100, 200 is installed in a paper tray, only tab stock 101 equivalent to the tab guide 100, 200 (i.e. 9"×11" tab stock when tab guide 100 is installed and A5 tab stock when tab guide 200 is installed) should be run from the paper tray 86.

Those skilled in the art will recognize from the configuration of the tab guides 100, 200 that the center of gravity of each tab guide 100, 200 is located in the trail edge guide-receiving aperture 116. In the illustrated embodiment the centers of gravity of the tab guides 100, 200 are located approximately 1.5-2 mm away from the trailing edge of the tab stock 101 received in the paper tray 86. Thus, when properly mounted to the trail edge guide 90, the tab guides have a tendency to rotate so that the distal wall 124 of the top flange 102 rotates upwardly. This permits the feeder head 58 to extract the top sheet from the stack 56 without marks being placed thereon by the sheet-engaging surfaces 120 of the top flange 102. To further reduce the likelihood of marking the tab stock 101, tab guides 100, 200 are fabricated from lightweight material such as a light weight polycarbonate ABS blend plastic. The illustrated tab guide 100 weighs approximately 37.6 grams, while the illustrated tab guide 200 weighs approximately 30 grams.

While the tab guide 100, 200 has been described for utilization with a specific paper tray 86 with a trail edge guide 90 having a specific configuration, those skilled in the art will recognize that a tab guide may be configured for utilization with another configuration of a trail edge guide within the scope of the disclosure.

Although the tab guide has been described in detail with reference to a certain embodiment, variations and modifications exist within the scope and spirit of the present disclosure as described and defined in the following claims.

What is claimed is:

1. A tab guide comprising:

a top flange having a top surface and a sheet-engaging surface;

a trailing edge flange having a substantially planar trailing edge-engaging surface; and a mount configured to couple the top flange to the trailing edge flange and to mount the top flange and the trailing edge flange to a trail edge guide of a printer paper tray, the top surface of the top flange engages a bottom of a stack height finger extending from a sheet-engaging face of the trail edge guide and the sheet-engaging surface of the top flange engages a top surface of a trailing edge of a top sheet in a stack of tab stock in the printer paper tray, and the trailing edge-engaging surface of the trailing edge flange engages tabs located on the trailing edge of a plurality of the uppermost sheets in the stack of tab stock received in the paper tray.

2. The tab guide of claim 1, the top flange further comprising:

a rear wall; and the mount further comprises:

a first side wall;

a second side wall; and a rear wall;

a portion of the rear wall of the top flange cooperates with the first side wall, the second side wall, and the rear wall of the mount to form an aperture for receiving the trail edge guide.

3. The tab guide of claim 2, the portion of the rear wall of the top flange, the top surface of the top flange, and the sheet-engaging surface of the top flange are configured to form a channel through which the stack height finger passes during mounting of the tab guide to the trail edge guide.

4. The tab guide of claim 3, the top surface of the top flange includes a depression positioned adjacent to the channel to engage the bottom of the stack height finger.

5. A tab guide for aligning tab stock in a paper tray of a printer comprising:

a top flange having a top surface and a sheet-engaging surface;

a trailing edge flange having a substantially planar trailing edge-engaging surface; and a mount coupling the top flange and the trailing edge flange, the mount being configured to mount the top flange and trailing edge flange of the tab guide to a trail edge guide of a printer paper tray to position the top surface of the top flange in engagement with a bottom of a stack height finger extending from a sheet-engaging face of the trail edge guide, to position the sheet-engaging surface of the top flange in engagement with a top surface of a trailing edge of a top sheet in a stack of tab stock received in the paper tray, and to position the trailing edge-engaging surface of the trailing edge flange in substantially a plane that is the same as the plane of the sheet-engaging face of the trail edge guide for engagement of the trailing edge-engaging surface of the trailing edge flange with tabs located on the trailing edge of a plurality of the uppermost sheets in the stack of tab stock received in the paper tray.

6. The guide of claim 5, wherein the top flange includes a rear wall and the mount comprises a first side wall, a second side wall and a rear wall, a portion of the rear wall of the top flange cooperates with the first side wall, the second side wall and the rear wall of the mount to form an aperture configured to receive the trail edge guide.

7. The tab guide of claim 6 wherein the portion of the rear wall, top surface, and sheet-engaging surface of the top flange are configured to form a channel through which the stack height finger passes during mounting of the tab guide to the trail edge guide.

8. The tab guide of claim 7 wherein the top surface of the top flange is formed to include a depression adjacent the channel, the depression being configured to engage the bottom of the stack height finger when the tab guide is mounted to the trail edge guide.

9. The tab guide of claim 8 wherein a portion of the sheet-engaging surface underlies the depression in a first plane and a portion of a bottom surface of the top flange lies in a second plane displaced from the first plane toward the top surface of the top flange.

10. The tab guide of claim 6 wherein the trailing edge flange includes a first portion coupled to the first side wall and extending away from the aperture in a first direction and a second portion coupled to the second side wall and extending away from the aperture in a second direction opposite the first direction, the first and second portions each having a sheet-engaging surface.

11. The tab guide of claim 10 wherein the first portion of the trailing edge flange includes a first distal end spaced apart from the first side wall, the second portion of the trailing edge flange includes a second distal end spaced apart from the second side wall and the first distal end is displaced from the second distal end by a length approximately equal to or less than a length of an uneven edge of tab stock with which the tab guide is to be utilized.

12. The tab guide of claim 11 wherein the top flange has a length approximately equal to the length between the first and second distal ends of the trailing edge flange.

13. The tab guide of claim 12, wherein the sheet-engaging surface of the top flange is substantially perpendicular to each of the trailing edge-engaging surfaces of first and second portions of the trailing edge flange.

14. The tab guide of claim 5 wherein the sheet-engaging surface of the top flange is substantially perpendicular to the trailing edge-engaging surface of the trailing edge flange.

15. A paper tray for an electrostatographic printer for properly aligning tab stock having an uneven edge including tabs to be processed with the uneven edge being the trailing edge of the tab stock, the paper tray comprising:

a sheet-receiving region for receiving a stack of sheets to be fed to the electrostatographic printer in a feed direction, the sheet-receiving region having a lead edge side and a trailing edge side having a length;

a trail edge guide adjacent the trailing edge side of the sheet-receiving region and movable into engagement with a trailing edge of a stack of sheets received in the sheet-receiving region, the trail edge guide including a sheet-engaging face having a width less than the length of the trailing edge side of the sheet-receiving region and a stack height finger extending from the sheet-engaging face in a process direction for engaging a top surface of a top sheet on a stack adjacent the trailing edge of the sheet; and a tab guide including:

a top flange having a top surface, a rear wall, and a sheet-engaging surface, a portion of the rear wall, top surface and sheet-engaging surface of the top flange being configured to form a channel through which the stack height finger passes during mounting of the tab guide to the trail edge guide;

a trailing edge flange having a substantially planar trailing edge-engaging surface; and a mount having a first side wall, a second side wall, and a rear wall, the mount coupling the top flange and the trailing edge flange, the portion of the rear wall of the top flange cooperating with the first side wall, the second side wall, and the rear wall of the mount to form an aperture configured to receive the trail edge guide and mount the top flange and trailing edge flange to the trail edge guide and position the top surface of the top flange in engagement with a bottom of the stack height finger, position the sheet-engaging surface of the top flange in engagement with a top surface of a trailing edge of a top sheet in a stack of tab stock received in the sheet-receiving region, and position the trailing edge-engaging surface of the trailing edge flange in engagement with tabs located on a trailing edge of a plurality of the uppermost sheets in the stack of tab stock received in the sheet-receiving region.

16. The tab guide of claim 15 wherein the top surface of the top flange is formed to include a depression adjacent the channel, the depression being configured to engage the bottom of the stack height finger when the tab guide is mounted to the trail edge guide.

* * * * *